US012144408B2

(12) United States Patent
Meersschaert

(10) Patent No.: US 12,144,408 B2
(45) Date of Patent: Nov. 19, 2024

(54) LUGGAGE CASES AND EXPANSION ZIPPER ASSEMBLIES AND OTHER PARTS FOR LUGGAGE CASES

(71) Applicant: Samsonite IP Holdings S. a.r.l., Luxembourg (LU)

(72) Inventor: Reinhard Meersschaert, Merelbeke (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 55 days.

(21) Appl. No.: 17/895,214

(22) Filed: Aug. 25, 2022

(65) Prior Publication Data

US 2023/0062734 A1 Mar. 2, 2023

(30) Foreign Application Priority Data

Aug. 25, 2021 (EP) ..... 21193031

(51) Int. Cl.
*A45C 7/00* (2006.01)
*A45C 13/04* (2006.01)

(52) U.S. Cl.
CPC ..... *A45C 7/0027* (2013.01); *A45C 13/04* (2013.01)

(58) Field of Classification Search
CPC ..... A45C 7/0027; A45C 13/04; A45C 5/03; A45C 13/103; A45C 2005/037
USPC ..... 190/103; 383/2
See application file for complete search history.

(56) References Cited

U.S. PATENT DOCUMENTS 3,443,671 A * 5/1969 Gordon ..... A45C 7/0027 383/61.3
4,987,657 A 1/1991 Moreland
6,092,266 A 7/2000 Lee
6,179,101 B1 * 1/2001 Lin ..... A45C 13/262 280/37
6,183,133 B1 2/2001 Roegner
6,305,587 B1 * 10/2001 Miller ..... G06F 1/1628 224/582

(Continued)

FOREIGN PATENT DOCUMENTS

CN 2426290 Y 4/2001
CN 2681597 Y 3/2005

(Continued)

OTHER PUBLICATIONS

Extended European Search Report for European Patent Application No. 21193031.8 dated Feb. 17, 2022, 7 pages.

(Continued)

*Primary Examiner* — Don M Anderson
*Assistant Examiner* — Justin Caudill
(74) *Attorney, Agent, or Firm* — Dorsey & Whitney LLP

(57) ABSTRACT

A luggage case includes a shell and a continuous closure structure, the continuous closure structure including a protective cover and separately or additionally an expansion zipper. The continuous closure assembly of the continuous closure structure includes a first strip portion and a second strip portion connected along a common outer edge. The second strip portion overlays a portion of the first strip portion. The expansion zipper assembly of the continuous closure structure includes a central webbing portion having zipper teeth on opposing sides, and a gusset member secured between the shell and the central webbing portion.

16 Claims, 15 Drawing Sheets

(56) References Cited

U.S. PATENT DOCUMENTS

| | | | | |
|---|---|---|---|---|
| 6,345,709 | B1 | 2/2002 | Cheng | |
| 7,232,018 | B1 * | 6/2007 | Salander | A45C 5/14 280/37 |
| 7,451,872 | B1 | 11/2008 | Allen | |
| 7,509,985 | B2 * | 3/2009 | Metsch | A45C 13/103 383/105 |
| 8,083,040 | B2 | 12/2011 | Chiang | |
| 8,201,672 | B2 | 6/2012 | Yang | |
| 8,869,960 | B2 | 10/2014 | Mangano | |
| 9,364,061 | B2 * | 6/2016 | Lewis | A45C 7/0068 |
| 9,380,846 | B2 | 7/2016 | Agarwal | |
| 9,826,808 | B2 * | 11/2017 | Yeh | A45C 5/02 |
| 9,894,970 | B2 | 2/2018 | Sheikh et al. | |
| 10,271,625 | B2 | 4/2019 | Wang | |
| 10,349,711 | B2 | 7/2019 | Chiang | |
| 10,555,587 | B2 | 2/2020 | Yu | |
| 2003/0000784 | A1 * | 1/2003 | Hsu | A45C 7/0027 190/903 |
| 2005/0286807 | A1 * | 12/2005 | Matheus | A45C 7/0063 190/103 |
| 2010/0269311 | A1 | 10/2010 | Jacobsen | |
| 2011/0186398 | A1 | 8/2011 | Sheikh | |
| 2011/0272232 | A1 * | 11/2011 | Sheikh | A45C 13/103 190/111 |
| 2013/0092490 | A1 * | 4/2013 | Moon | A45C 7/0031 190/18 A |
| 2013/0140118 | A1 * | 6/2013 | Benshetrit | A45C 7/0018 190/103 |
| 2013/0220755 | A1 * | 8/2013 | Meersschaert | A45C 13/36 190/18 A |
| 2014/0245519 | A1 | 9/2014 | Ly | |
| 2014/0353104 | A1 * | 12/2014 | Sheikh | A45C 7/0022 190/119 |
| 2015/0021133 | A1 * | 1/2015 | Xu | A45C 5/03 190/18 A |
| 2015/0034440 | A1 * | 2/2015 | Lai | A45C 7/0027 190/103 |
| 2016/0157574 | A1 * | 6/2016 | Liao | A45C 13/103 190/119 |
| 2016/0262511 | A1 * | 9/2016 | Lusson | A45C 7/0022 |
| 2020/0352292 | A1 | 11/2020 | Naparstek et al. | |
| 2021/0052055 | A1 * | 2/2021 | Arias | A45C 13/02 |

FOREIGN PATENT DOCUMENTS

| | | | |
|---|---|---|---|
| CN | 201550709 | U | 8/2010 |
| CN | 102188082 | A | 9/2011 |
| CN | 202077767 | U | 12/2011 |
| CN | 202127972 | U | 2/2012 |
| CN | 102421322 | A | 4/2012 |
| CN | 202514792 | U | 11/2012 |
| CN | 103844451 | B | 7/2016 |
| CN | 208243037 | U | 12/2018 |
| CN | 209359850 | U | 9/2019 |
| CN | 210471202 | U | 5/2020 |
| CN | 212994901 | U | 4/2021 |
| CN | 112848227 | A | 5/2021 |
| CN | 213154419 | U | 5/2021 |
| CN | 213154420 | U | 5/2021 |
| CN | 213154421 | U | 5/2021 |
| CN | 112932032 | A | 6/2021 |
| CN | 112263055 | B | 7/2021 |
| CN | 213663997 | U | 7/2021 |
| CN | 213664000 | U | 7/2021 |
| CN | 213664001 | U | 7/2021 |
| CN | 213664002 | U | 7/2021 |
| CN | 213664005 | U | 7/2021 |
| CN | 213992694 | U | 8/2021 |
| CN | 214547726 | U | 11/2021 |
| CN | 214547733 | U | 11/2021 |
| CN | 215014105 | U | 12/2021 |
| CN | 215800298 | U | 2/2022 |
| DE | 20217001 | U1 | 1/2003 |
| EP | 1589848 | | 11/2005 |
| EP | 1638427 | B1 | 2/2010 |
| EP | 2374366 | A1 | 10/2011 |
| EP | 2545800 | A1 | 1/2013 |
| EP | 2421403 | B1 | 4/2015 |
| EP | 2710916 | B1 | 11/2017 |
| FR | 1427400 | A | 2/1966 |
| FR | 2944676 | A1 | 10/2010 |
| FR | 2951915 | A1 | 5/2011 |
| GB | 2173393 | A | 10/1986 |
| GB | 2403211 | A | 12/2004 |
| TW | 1540976 | B | 7/2016 |
| WO | 9707702 | A1 | 3/1997 |
| WO | 99/055189 | A3 | 11/1999 |
| WO | 2005000067 | A1 | 1/2005 |
| WO | 2010122247 | A2 | 10/2010 |
| WO | 2010122247 | A3 | 1/2011 |

OTHER PUBLICATIONS

International Search Report and Written Opinion for International Patent Application No. PCT/EP2022/073724, dated Oct. 10, 2022, 12 pages.

* cited by examiner

LUGGAGE CASES AND EXPANSION ZIPPER ASSEMBLIES AND OTHER PARTS FOR LUGGAGE CASES

CROSS-REFERENCE TO RELATED APPLICATION

This application claims priority to European Patent Application No. 21193031.8, filed Aug. 25, 2021 and entitled "Luggage Cases and Expansion Zipper Assemblies and other Parts for Luggage Cases", which is hereby incorporated by reference herein in its entirety for all purposes.

BACKGROUND

The present disclosure relates to luggage cases and/or expansion zipper assemblies and other parts for luggage cases. One of the more important aspects of a luggage case is the continuous closure, or zipper, mechanism. The zipper mechanism is important because it is central to the function of the luggage case for opening, closing, and possibly expanding the internal volume; it impacts the appearance; and is a relatively expensive component affecting the cost of manufacture. The zipper mechanism is also subject to significant wear-and-tear during use and handling, and is often a point of malfunction or failure as a result.

One issue with continuous closure mechanisms is the additional weight and complication associated with available expansion zipper structures. Some commonly used expansion zipper structures are relatively heavy because they may include strength-enhancing structure to provide localized reinforcement of the luggage shell near the expansion zipper. The reinforcing structure may utilize wire beading or other such features. Addition of the reinforcing structure not only increases the weight, but often also increases the number of components and assembly steps required to construct the luggage case.

Another is the protection of zipper mechanisms from damage caused by the rigors of baggage handling. Typical protection structures include Z-shaped thermoplastic extrusions secured to the edge of the luggage case and covering a portion of the zipper mechanism, in one example. The typical protective structures are an additional component to the zipper mechanism, complicating assembly of the luggage case, increasing the weight, and increasing related costs.

There is a need for an improved continuous closure mechanism having, separately or together, a protective structure and an expansion zipper structure that addresses one or all of the noted shortcomings.

SUMMARY

A luggage case is disclosed. In one embodiment, the luggage case includes a first shell and a second shell; first engagement features extending along an edge of the first shell; second engagement features extending along an edge of the second shell; an expansion webbing, such as for example an unreinforced expansion webbing, positioned at least partially between the first and second shells, and defining opposing first and second edges, with each opposing edge including engagement features. The respective engagement features of the first opposing edge and the first shell correspond to form a first openable zipper structure. The engagement features of the second opposing edge and the second shell correspond to form a second openable zipper structure. A gusset member is connected to the expansion webbing and operably joined with the second shell. The first openable zipper structure is arranged to allow access to an interior chamber formed between the first and second shells, and the second openable zipper structure is arranged to allow the gusset member to extend to increase the volume of the interior chamber when in the open configuration.

Optionally, in some embodiments the gusset member is attached directly to the second luggage shell.

Optionally, in some embodiments the first engagement features are attached to an elongated first zipper tape, and the elongated first zipper tape is attached to the first luggage shell; the second engagement features are attached to an elongated second zipper tape, and the elongated second zipper tape is attached to the second luggage shell; and the gusset member is attached to the elongated second zipper tape.

Optionally, in some embodiments the gusset member is attached to the elongated second zipper tape by a line of stitching.

Optionally, in some embodiments the expansion webbing is an elongated strip of material.

Optionally, in some embodiments the expansion webbing is a continuous piece of material.

Optionally, in some embodiments the expansion webbing is made of a same material as the zipper tapes.

Optionally, in some embodiments the webbing material is a single layer or is a plurality of layers.

Optionally, in some embodiments the gusset member defines an opposing first edge and an opposing second edge; the opposing first edge is attached to the elongated first zipper tape; and the opposing second edge is attached to the elongated second zipper tape.

Optionally, in some embodiments the first and second zipper tapes are each defined by an elongated strip member associated with the each shell, each elongated strip member including a first strip portion and a second strip portion joined along a first common edge; the first strip portion including engagement features along a first edge opposite the first common edge, and the first strip portion is attached near an edge of the respective shell between the first edge and the first common edge; and the second strip portion defines an inner edge, the second strip portion extending over at least a portion of a width of the first strip portion to cover the attachment of the first strip portion to the shell.

Optionally, in some embodiments the first strip portion is attached to the respective shell by a line of stitching.

Optionally, in some embodiments the second strip portion is free from direct attachment to the shell and can be folded back to expose the line of connection.

Optionally, in some embodiments the second strip portion includes a protective material.

Optionally, in some embodiments the protective material is a thermoplastic material applied to the second strip portion or is a thermoplastic material impregnated into the second strip portion.

Optionally, in some embodiments the first strip portion includes webbing and the second strip portion includes a webbing or a webbing together with a coating layer.

Optionally, in some embodiments the engagement features include zipper coils or zipper teeth.

Optionally, in some embodiments the second strip portion is formed integrally with the first strip portion and the first common edge is formed by a fold, or is a separate piece from the first strip portion and is attached to the first strip portion to form the first common edge.

Optionally, in some embodiments the second strip portion is a separate piece from the first strip portion and is attached to the first strip portion to form the first common edge; and the second strip portion is a flexible thermoplastic material.

Optionally, in some embodiments the second strip portion includes a rigid or semi rigid material.

Optionally, in some embodiments the second strip portion is curved concave downwardly with respect to the first layer, where a central region of the second layer is spaced away from the first layer.

Optionally, in some embodiments the inner edge of the second strip portion at least partially engages along its length the first layer.

Optionally, in some embodiments the elongated strip member further includes a third strip portion joined along the first edge of the first strip portion to form a second common edge. The second common edge covers a free end of the edge of the respective shell.

Optionally, in some embodiments the first strip portion extends over an outer surface of the respective shell; and the third strip portion extends over an inner surface of the respective shell.

Optionally, in some embodiments the first strip portion and the third strip portion are attached near an edge of the respective shell between the first and second common edges.

Optionally, in some embodiments the first strip portion and the third strip portion are attached to the respective shell by a line of stitching.

Optionally, in some embodiments the third strip portion is formed integrally with the first strip portion and the second common edge is formed by a fold, or the third strip portion is formed separate from the first strip portion and attached to the first strip portion to form the second common edge.

Optionally, in some embodiments the second openable zipper defines a second opposing end, the second opposing end received in a clip; at least a first slit is formed in the webbing portion between the attachment of the gusset portion to the webbing portion and the engagement features of the second opposing edge, or is formed in the second zipper tape between the attachment of the second engagement members and the attachment of the gusset member to the second zipper tape; and the slit widens to form a gap when the expansion zipper is opened to allow second openable zipper to open and expand the internal volume of the luggage case.

Optionally, in some embodiments at least a first slit is formed in the webbing portion between the attachment of the gusset portion to the webbing portion and the engagement features of the second opposing edge; and at least a second slit is formed in the second zipper tape between the attachment of the second engagement members and the attachment of the gusset member to the second zipper tape; and each of the at least first and the at least second slits widen to each form at least one gap when the expansion zipper is opened, the at least one gap allow the second openable zipper to open and extend and expand the internal volume of the luggage case.

Optionally, in some embodiments the first openable zipper defines first opposing ends, the first opposing ends positioned adjacent one another, the first opposing ends retained by a first clip; the second openable zipper defines second opposing ends, the second opposing ends positioned adjacent one another, the second opposing ends retained by a second clip; an end portion of each opposing end of the second zipper tape deviates away from the edge of the second luggage shell when the expansion zipper is opened to allow the second openable zipper to extend and expand the internal volume of the luggage case.

Optionally, in some embodiments a gap is formed between the second zipper tape and the second edge of the second luggage shell.

Optionally, in some embodiments the first openable zipper structure defines first opposing ends adjacent one another; the second openable zipper structure defines second opposing ends adjacent one another; the first and second adjacent opposing ends aligned with one another; where a laterally expandable hinge overlies the first and second opposing ends.

Optionally, in some embodiments the hinge is formed of an expandable material and defines a first edge coupled to the first shell and a second edge coupled to the second shell, and extends over the first openable zipper structure and the second openable zipper structure in both the unexpanded configuration and in the expanded configuration.

Optionally, in some embodiments in the width of the hinge in the expanded configuration is approximately 55% greater than the width of the hinge in the expanded configuration.

Optionally, in some embodiments the shell includes a bottom panel defining a recess; the recess includes a length dimension defined by opposing end walls, a depth dimension defined by a front edge and a rear wall, and a height dimension defined by the bottom panel and the top wall; where at least a portion of the top wall along its length forms an undercut and angles upwardly as it extends from the front edge to the rear wall.

Optionally, in some embodiments the top wall has an arcuate shape with a maximum height dimension at a central portion and being less than the maximum height at each of the opposing end walls; the distance between each opposing end wall and an adjacent curved sidewall of a wheel housing is smallest at a midpoint of each opposing end wall; and the opposing end walls and front edge and rear wall combine to form a generally trapezoidal shape.

In one embodiment a luggage case includes a first shell and a second shell; a continuous closure assembly selectively joining the first and second shell and including: an elongated strip member associated with each shell, each elongated strip member including a first strip portion and a second strip portion joined along a first common edge; the first strip portion including engagement features along a first edge opposite the common edge, and the first strip portion is attached near an edge of the respective shell between the first edge and the first common edge; and the second strip portion defines an inner edge, the second strip portion extending over at least a portion of a width of the first strip portion to cover the attachment of the first strip portion to the shell.

Optionally, in some embodiments the first strip portion is attached to the respective shell by a line of stitching.

Optionally, in some embodiments the second strip portion is free from direct attachment to the shell and can be folded back to expose the line of connection.

Optionally, in some embodiments the second strip portion includes a protective material.

Optionally, in some embodiments the protective material is a thermoplastic material applied to the second strip portion or is a thermoplastic material impregnated into the second strip portion.

Optionally, in some embodiments the first strip portion includes webbing and the second strip portion includes a webbing or a webbing together with a coating layer.

Optionally, in some embodiments the second strip portion is formed integrally with the first strip portion and the first common edge is formed by a fold, or is a separate piece from the first strip portion and is attached to the first strip portion to form the first common edge.

Optionally, in some embodiments the second strip portion is a separate piece from the first strip portion and is attached to the first strip portion to form the first common edge; and wherein the second strip portion is a flexible thermoplastic material.

Optionally, in some embodiments the second strip portion is curved concave downwardly with respect to the first layer, and wherein a central region of the second layer is spaced away from the first layer.

Optionally, in some embodiments the inner edge of the second strip portion at least partially engages along its length the first layer.

Optionally, in some embodiments the elongated strip member further includes a third strip portion joined along the first edge of the first strip portion to form a second common edge; and wherein the second common edge covers a free end of the edge of the respective shell.

Optionally, in some embodiments the first strip portion extends over an outer surface of the respective shell; and the third strip portion extends over an inner surface of the respective shell.

Optionally, in some embodiments the first strip portion and the third strip portion are attached near an edge of the respective shell between the first and second common edges.

Optionally, in some embodiments the first strip portion and the third strip portion are attached to the respective shell by a line of stitching.

Optionally, in some embodiments the third strip portion is formed integrally with the first strip portion and the second common edge is formed by a fold, or the third strip portion is formed separate from the first strip portion and attached to the first strip portion to form the second common edge.

Optionally, in some embodiments the engagement features are affixed to the second common edge.

An expansion zipper assembly for a luggage case is disclosed. In one embodiment the expansion zipper assembly includes, a first zipper tape including engagement features along one edge; a second zipper tape including engagement features along one edge; an expansion webbing defining opposing edges and positioned between the first and second zipper tapes, with each opposing edge forming an openable zipper structure with the adjacent engagement features of the first or second zipper tape; a gusset member defining a first and second opposing edges, the first opposing edge attached to the expansion webbing and the second opposing edge attached to second zipper tape.

A luggage case is disclosed. In one embodiment the luggage case includes a first shell and a second shell defining an interior chamber. An expansion zipper assembly is attached between the first shell and the second shell and includes: a first zipper tape attached to the first shell and including engagement features along one edge; a second zipper tape attached to the second shell and including engagement features along one edge; an expansion webbing defining opposing edges and positioned between the first and second zipper tapes with each opposing edge forming a selectively openable zipper structure with the adjacent engagement features of the first or second zipper tape; a gusset member defining a first and second opposing edges, the first opposing edge attached to the expansion webbing and the second opposing edge attached to the second zipper tape. The selective openable zipper structure is formed between the first zipper tape and the expansion webbing defines a primary zipper structure allowing access to the interior chamber, and the selectively openable zipper structure formed between the second zipper tape and the expansion webbing defines an expansion zipper structure that when open allows the gusset member to extend and expand the volume of the interior chamber.

A luggage case is disclosed. The luggage cases includes a shell and a continuous closure structure, the continuous closure structure including a protective cover and separately or additionally an expansion zipper. The continuous closure assembly of the continuous closure structure includes a first strip portion and a second strip portion connected along a common outer edge. The second strip portion overlays a portion of the first strip portion. The expansion zipper assembly of the continuous closure structure includes a central webbing portion having zipper teeth on opposing sides, and a gusset member secured between the shell and the central webbing portion.

Additional embodiments and/or features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various examples of the present disclosure and should not be construed as a complete recitation of the scope of the disclosure, characterized in that.

DETAILED DESCRIPTION

Figure 1B:
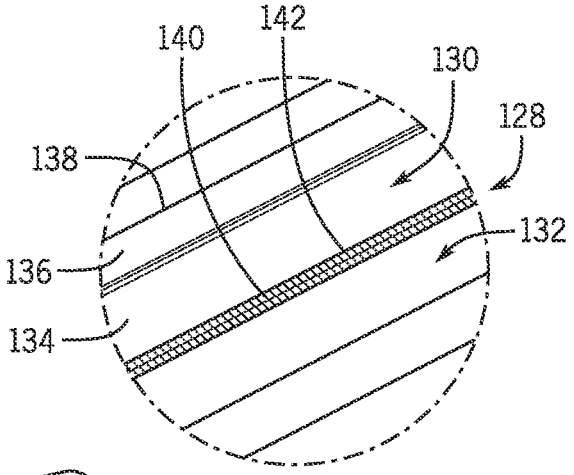
FIG. 1B shows a perspective view of a continuous closure assembly according to some examples of the present disclosure.

The improved continuous closure structures (e.g., zipper closures) described herein may include improved continuous closure assemblies having protective covers and/or expansion assemblies, implemented separately or implemented in combination. Either or both of an improved continuous closure assembly having a protective cover or an expansion assembly may simplify construction of luggage articles by reducing the complexity and number of operations associated with assembling a luggage article. For example, some implementations herein provide continuous closure structures with a continuous closure assembly (for example zipper closure mechanisms), having a protective cover which may include an elongated strip member defining a first elongated strip portion and a second elongated strip portion. The first and second strip portions are joined along a common long edge. The first strip portion may be secured to an edge of a luggage article, for instance by stitching. The first strip portion includes engagement features, such as zipper teeth, along a long edge opposite the common long edge shared with the second strip. The second strip portion at least partially overlies the first strip portion, such as by being folded along the common long edge. The second strip portion overlays and protects at least a portion of the first strip portion. A line of stitching that may secure the first strip portion to the luggage shell may be overlaid by the second strip portion to protect it from abrasion and other damage.

Some other implementations of continuous closure assemblies provided herein may additionally include a third elongated strip portion attached along a second common edge with the first strip, and may overlay each other by being folded along the second common edge, which forms a line of connection. The first and third strip portions may form a trim cover over an unfinished edge of a luggage article that may be received between the first and third strip portions. Either of the above continuous closure assemblies may be made easily and inexpensively in long lengths, similar to a simple single zipper tape. Affixing either of the above enhanced continuous closure assemblies to a luggage article may include similar operations to affixing a simple single zipper tape to a luggage article, and is thus efficient and creates little if any additional manufacturing complications or costs.

Typical protective covers for zipper structures may include elongated S-shaped extruded edge pieces, as discussed below with respect to FIGS. 6A and 6B. The extruded pieces are separate and additional to the zipper structure, and are a structure additional to the zipper structure to be assembled, aligned, and attached to the edge of the luggage shell, complicating the construction and increasing the cost of the luggage case.

The continuous closure assemblies provided herein allow for a protective cover overlaying a portion of the zipper mechanism that may be attached to the luggage shell together with the zipper without requiring an additional attachment and/or an additional component that complicates assembly and adds expense. The continuous closure assembly with a protective cover as described and claimed herein is distinct from the extruded protective cover in a variety of ways. Primarily, it is simpler to implement since it is a part of the zipper structure application to and alignment with the zipper structure before attaching to the luggage shell, which reduced complications and assembly expense. It is also able to be made in continuous lengths of strip material form and cut to the proper length without further processing or assembly, further reducing expense. In at least these ways the continuous closure assembly having a cover is distinct from typical protective covers.

In another aspect, a continuous closure structure may also provide for expansion of a luggage article by use of less complex zipper construction and fewer steps than traditional expansion zippers. For example, expansion zipper assemblies described herein may provide a first zipper tape with engagement features on one shell, a second zipper tape with engagement features on the other shell, and an elongated central webbing having engagement features on both of its opposing edges positioned between the first and second zipper tapes. The elongated central webbing may be a flexible, unreinforced fabric material, such as that typically used for a zipper tape. A flexible gusset member may be operably joined to the second shell along one edge, such as for example by being attached to the second zipper tape, and to the central webbing along another edge. The engagement features, as referred to throughout, may be for example zipper teeth or zipper coils. The first zipper tape may engage with one edge of the central webbing and form the primary zipper mechanism for opening the luggage case. The second zipper tape may engage with the opposite edge of the central webbing to form the expansion zipper mechanism to allow the gusset member to expand to full width and increase the interior volume of the luggage case.

The improved luggage article zipper arrangement described herein may be suitable for use on many different types of luggage articles, including but not limited to hard-sided luggage cases, soft-sided luggage cases, hybrid luggage cases, duffle bags, brief cases, messenger bags, and backpacks. The description of the improved luggage article zipper arrangement is described herein with respect to a hard sided luggage case having a first shell and a second shells by way of example only, however the invention is particularly suitable and beneficial for use on such hardside luggage.

Figure 1A:
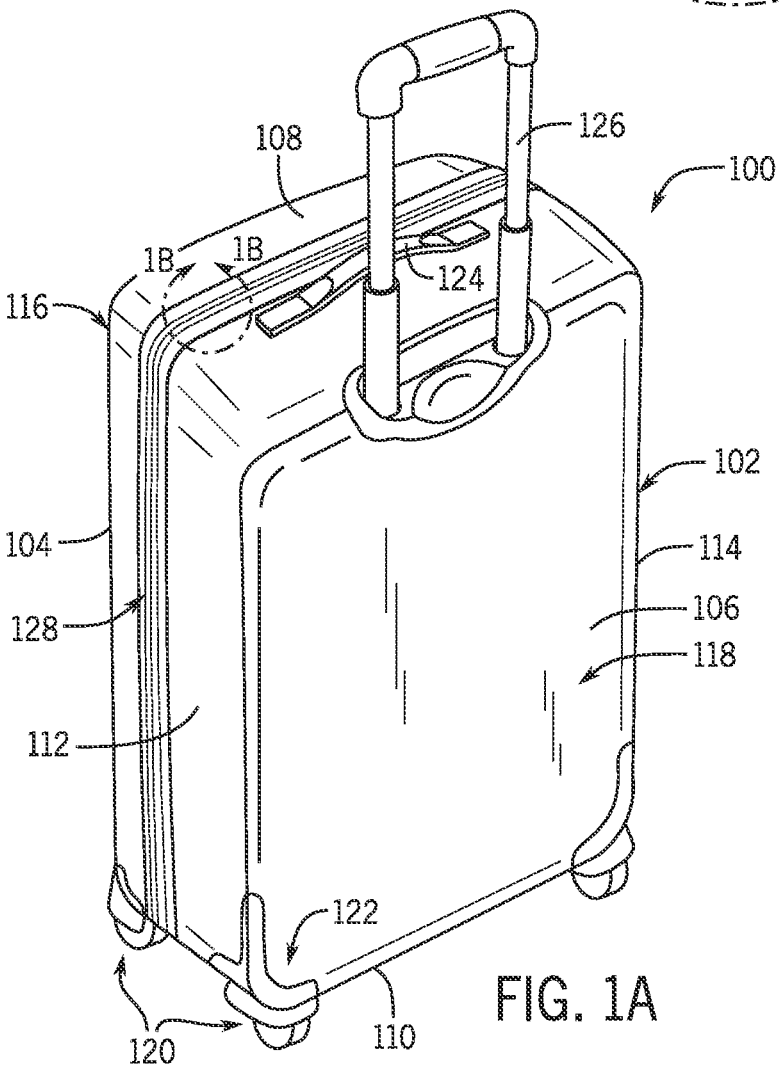
FIG. 1A is an isometric view of a luggage article in a closed configuration including a continuous closure assembly according to some examples of the present disclosure.

FIG. 1A is an isometric view of a luggage article in a closed configuration according to some examples of the present disclosure. A luggage article 100 according to an embodiment of the present disclosure includes a luggage case 102 formed from a plurality of walls or panels defining an internal compartment and storage volume in which to carry a user's belongings. As shown, the luggage article 100 includes a front panel 104 opposing a rear panel 106, a top panel 108 opposing a bottom panel 110, and a left panel 112 opposing a right panel 114 that collectively define a pair of opposing shells 116, 118 and the outer structure of the luggage case 102. As shown, a plurality of wheel assemblies 120, which may be caster-type wheel assemblies, may be coupled to at least the bottom panel 110, such as at the lower corner regions 122.

The luggage article 100 may also include one or more carry handles 124, typically one on one side (e.g 114, not shown), and another (124) on the top panel 108 of the luggage article 100. The luggage article 100 may also include an extendable or telescopic tow handle 126 attached to at least one panel of the luggage case 102, such as to the rear panel 106.

With continued reference to FIG. 1A, the luggage case 102 in this example comprises two shells 116, 118 secured by a continuous closure assembly 128, such as for example a zipper structure, extending across at least the top panel 108, left panel 112, and bottom panel 110. The continuous closure assembly 126 may continue along a portion of the right panel 114, and a hinge structure may be formed on the right panel 114 such that two halves (shells 116, 118) of the luggage case 102 remain connected by the hinge when the continuous closure assembly 128 is disconnected and the shells 116, 118 rotate apart about the hinge to access the interior volume of the luggage case 102. The shells may define an inner surface and an outer surface, and may be formed from materials used to construct hard-sided or rigid luggage cases, such as a plastic material, such as polypropylene, polyurethane, self-reinforced polypropylene, or other materials.

FIG. 1B show an enlarged view of a portion of one example of a continuous closure assembly 128. Also refer to FIGS. 2A, 2B, and 2C. The continuous closure assembly 128 may include a first elongated strip member 130 joined to an edge of the first luggage shell 116 and a second elongated strip member 132 joined to an edge of the second luggage shell 118. Elongated strip member 130 includes a first elongated strip portion 134, and a second elongated strip portion 136, joined along a first common edge 138. The second elongated strip portion 136 overlays at least a portion of width of the first elongated strip portion 134, and acting as a protective cover may extend over a line of stitching 150 that secures the first elongated strip portion 134 to an edge of the first luggage shell 116. Engagement features 140, such as zipper teeth or zipper coils, are positioned on the first strip portion 134 along a first or inner edge 142 opposite the common edge 138. The second elongated strip member 130 has the same or similar structures as defined for the elongated strip member 130.

Since the second strip portion 136 is joined to the first strip portion 134 along a first common edge 138 (for example, a fold), the second strip portion is joined to the luggage shell when the first strip portion 134 is attached to the luggage shell, such as by the line of stitching 150. A separate stitching or connection operation may not be needed to attach the second strip portion 136 to the first shell 116. This approach of attaching each elongated strip members 130, 132, of the continuous closure assembly 128 to their respective shells 116, 118 with a single stitching operation simplifies construction, and reduces costs, of the luggage case over other protective closure mechanisms, which may use multiple subcomponents requiring multiple stitching or connecting operations.

Figure 2A:
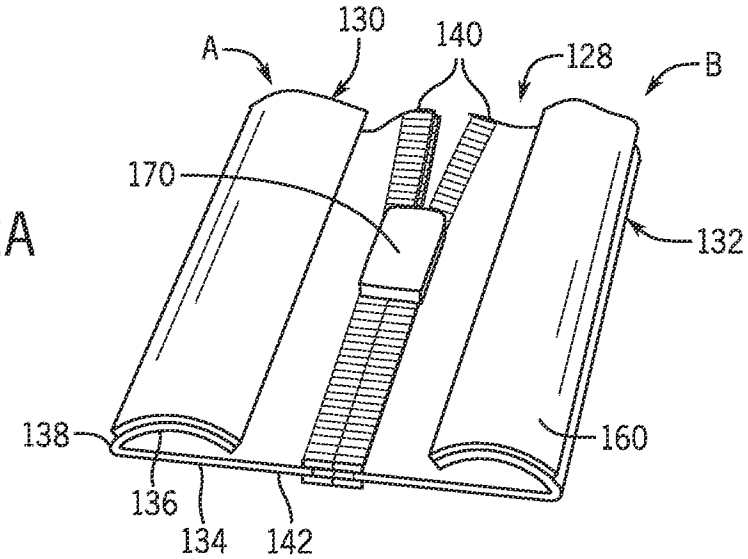
FIG. 2A shows a perspective view of a continuous closure assembly according to some examples of the present disclosure.
Figure 2B:
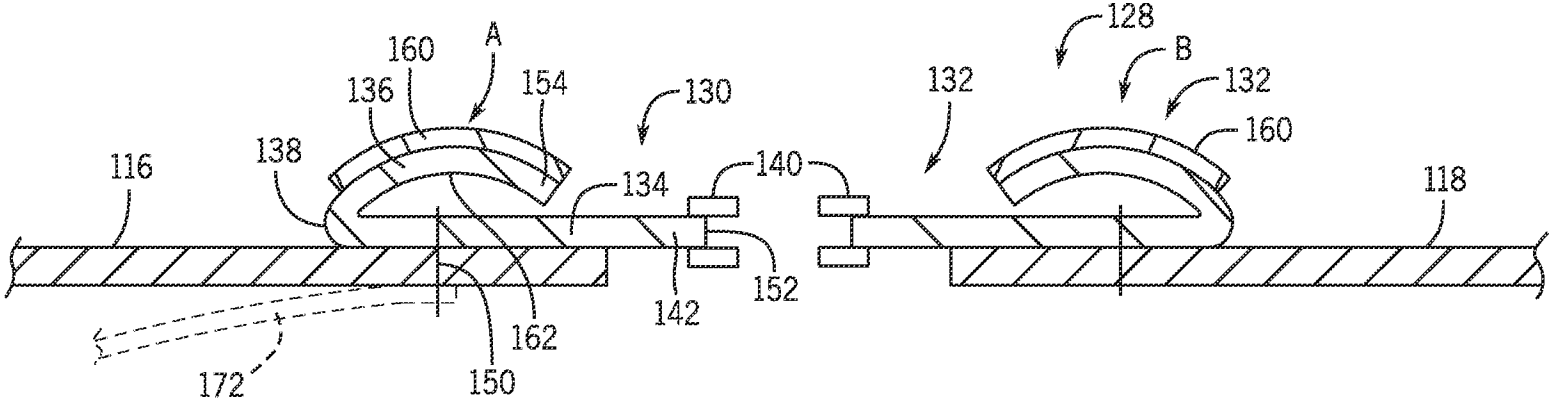
FIG. 2B shows a section view of the continuous closure assembly according to some examples of the present disclosure, taken along line 2B-2B of FIG. 2C.
Figure 2C:
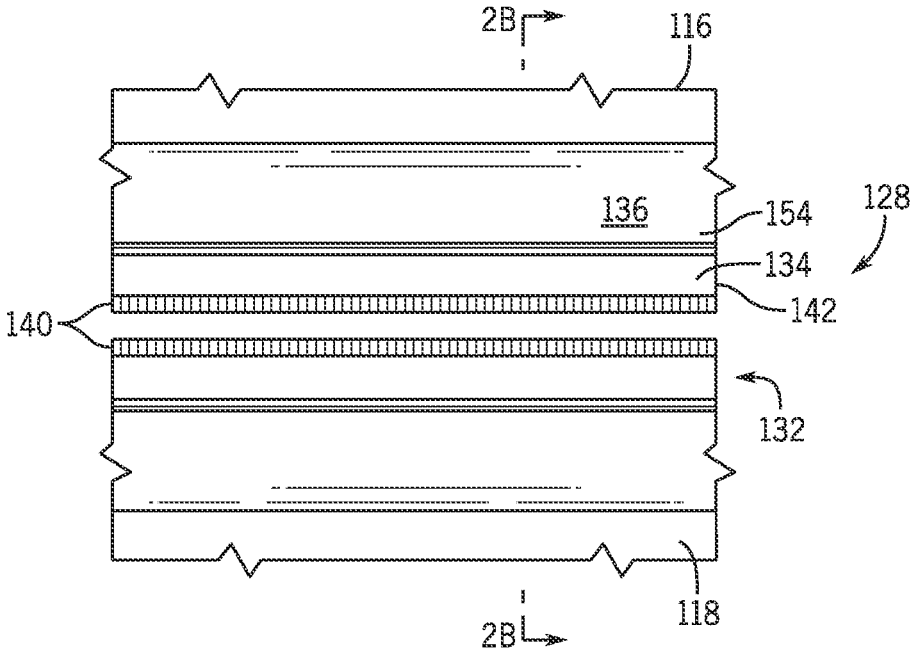
FIG. 2C shows a plan view of the continuous closure assembly according to some examples of the present disclosure.

Referring to FIGS. 2A, 2B and 2C, one example of the continuous closure assembly 128 is shown in more detail. The continuous closure assembly 128 may incorporate a protective cover portion, such as the second elongated strip member 136, and is attached between two shells 116, 118 of luggage case 102 to allow selective joining of the two shells. The engagement features 140 are adapted to be releasably connected by a slider 146 to open or close the luggage case, as is conventional. The engagement features 140 may be zipper teeth or zipper coils (each 148).

Figure 2D:
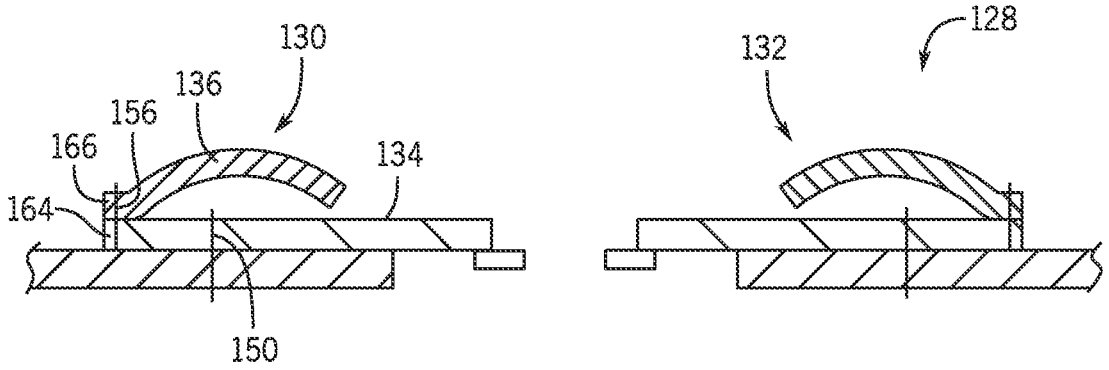
FIG. 2D shows a section view similar to FIG. 2B but with a different example of the continuous closure mechanism.

The continuous closure assembly 128 includes two substantially identical or symmetrical structures, A and B, attached to the first shell 116 and the second shell 118 respectively. The description of the continuous closure assembly 128 herein and throughout is generally of only one side, such as side A, with the understanding that the other side, such as side B, is substantially identical or symmetrical unless otherwise noted. Side A of the continuous closure assembly 128 includes the elongated strip member 130 defining a first strip portion 134 and a second strip portion 136. The elongated first strip portion 134 may be made of a webbing material, such as a woven or knitted fabric, and which is commonly used as zipper tape. The first strip portion 134 includes engagement features 140 along a first, or inner, edge 142, and is attached, such as by a line of stitching 150, at or near a free edge 152 of the first shell 116. In the example shown in FIG. 2A, the first 134 and second 136 strip portions are formed from a single strip member, and are delineated by a fold line 138 extending along the length of the strip member 130. The fold line 138 in this example defines the first common edge 138 between the first strip portion 134 and the second strip portion 136. The fold line 138, together with the first edge 142, defines a width of the first strip portion 134. An inner edge 154 of the second strip portion 136 is opposite the first common edge 148, and defines a width of the second strip portion 136. The fold line 138 also defines and effectively joins or attaches adjacent edges of the first strip portion 134 and the second strip portion 136. In alternative examples, for example shown in FIG. 2D, the first 134 and second 136 strip portions may be separate strip portions secured together along adjacent edges 164, 166, respectively, to form the elongated strip member 130. For example, the second strip portion 136 may be positioned on the first strip portion 134 with their respective adjacent edges aligned and secured together, such as by stitching 156, adhesive, or bonding, such as shown in FIG. 2D. In this example the first 134 and second 136 strip portions may not be folded relative to one another.

Referring back to FIGS. 2A, 2B, and 2C, the second strip portion 136 may partially or entirely overlay the width of the first strip portion 134. The second strip portion 136 may extend across the width of the first portion a sufficient amount to overlay the line of stitching 150 that secures the first strip portion 134 to the first shell 116.

The second strip portion 136 may include a protective material 160. For instance, as shown in FIGS. 2A and 2B, the protective material 160 may be applied to the side of the second strip portion 136 facing away from the first strip portion 134. The protective material 160 may be a coating layer applied to the second strip portion 136, or may be impregnated into the second strip portion 136. Alternatively, the second strip portion 136 may be made entirely of a protective material 160 and attached to the first strip portion 134 along the first common edge 138 as shown for example in FIG. 2D. The width of the protective material 160 may extend partially across the width of the second strip portion 136, or entirely across the width of the second strip portion 136 as is shown in FIG. 2A. The protective material may extend partially or entirely along the length of the second strip portion 136. In some embodiments, the second strip portion 136 preferably extends across most of the width of the first strip portion 134 towards the zipper teeth and opposing distal edge. In some embodiments the second strip portion 136 extends towards the zipper teeth over the stitching 150. In some embodiments, the second strip portion preferably extends towards the zipper teeth near to but just short of the edge of the zipper teeth (so as to allow the zipper slider to freely move) to thereby protect the stitching attachment and also first strip portion 134.

The protective material 160 may have one or more characteristics that may mitigate damage to the first strip portion 134, such as being a waterproof or water-resistant barrier, abrasion resistant, and/or tear resistant. The protective material may be, for example, thermoplastic polyurethane (TPU), rubber, silicone, or other type of water-resistant, waterproof, and/or wear resistant material. The protective layer 160 may have a color.

The second strip portion 136 may define a curved shape across all or at least part of its width dimension, as best seen in FIGS. 2A and 2B. The curved shape may be concave downwardly, as shown, or may be concave upwardly. In implementations where the second strip portion 136 is curved concave downwardly with respect to the first strip portion 134, a central portion 162 of the width of the second strip portion 136 may be spaced away from the first strip portion 134, with the inner edge 154 of the second strip portion 136 being close to or engaging the first strip portion 134. This positioning of the inner edge 154 of the second strip portion 136 may enhance the protection of the covered part of the first strip portion 134. In some examples, the inner edge 154 of the second strip portion 136 is positioned close to or engaging the first strip portion 134 between the line of stitching 150 and the first edge 142 of the first strip portion 134. This close positioning or engagement may better protect the first strip portion 134, for example including the line of stitching 150 (if covered), from damage (e.g., water damage, puncture damage, or abrasion damage). Additionally, where the protective material 160 is bonded to or impregnated into the second strip portion 136 comprising woven material with dimensional stability, there is a reduced likelihood that the second strip portion 136 will deform during use, such as for example flipping inside-out around the corners of the luggage case. Additionally, a curved second strip portion 136 is likely to create and/or maintain a uniform appearance, and may remain in position overlying the first strip portion 134 as the luggage case is used. Accordingly, the second strip portion 136 may better provide a protective covering over the line of stitching so that it is less likely to be damaged during rough handling.

The curved shape of the second strip portion 136 with the protective material 160 applied, such as for example in layer form or in impregnated form, or another form, may be obtained by heat forming the second strip portion 136 and the protective layer. Where the protective material is a thermoplastic or other heat-setting or heat-forming material, a curved press mold may be utilized. In one example, after heat forming, the second strip portion 136 may be cooled while retained in a curved shape to aid in retention of the desired shape.

Referring now to FIG. 2B, the thickness of the first or second elongated strip members 130, 132 respectively, may be approximately 0.5 mm. The thickness of the protective material 160, where applied as a coating layer to the second strip portion 136, may be approximately 0.05 mm to approximately 0.30 mm, with a thickness of approximately 0.15 mm being one acceptable option. Where the width of the second strip portion 136 is such that the inner edge 154 does not interfere with the closure mechanism (for example the zipper coils and slider), the protective material 160 may be relatively thick, such as having a greater thickness than existing coated zipper tapes.

The engagement features 140 may be, as shown in FIG. 2B, a zipper coil or zipper teeth 148, secured to an inner edge 142 of the first strip portion 134, and correspondingly to an inner edge 158 of the second strip portion 136. As shown in FIG. 2B, a zipper coil 148 may be positioned on a top surface of the first strip portion 134 and a zipper coil 148 positioned on a bottom surface of the first strip portion 134, and correspondingly on the second elongated strip member 132. Where top and bottom zipper coils 148 are utilized, a single slider device 170 may be used to secure both the top and bottom zipper coils on the first elongated strip portion 130 to corresponding top and bottom zipper coils on the second elongated strip portion 132, effecting the opening and closing of the continuous closure assembly 128. Zipper coils 148 may be positioned only one of the top or bottom of the first strip portion 134, and correspondingly the second elongated strip member 132, and a slider device suitable for selectively securing the single zipper coils 148 together may be used. Other types of engagement features 140 may be also be acceptable for use, including a zipper with injected teeth bonded to the tap, a zipper with injected teeth stitched to the tape, a zipper including an outward facing coil, a zipper with an inward facing coil, a zipper including a double coil, or other types of interlocking continuous closure assemblies.

The line of stitching 150 affixing the first strip portion 134 to the shell, as shown in FIG. 2B, may extend along the length of the first strip portion 134. The line of stitching 150 may be substantially parallel to and spaced inward from the first common edge 138 of the first strip portion 134 and the second strip portion 136. In some implementations, the line of stitching 150 may affix additional components on the interior or exterior of the luggage case. For example, some implementations may include a lining 172 adjacent to the inner surface of the shell also secured by the stitching.

FIG. 2C is a plan view of the continuous closure assembly 128 in an open configuration, and shows the second strip portion 136 of both sides A and B overlying less than 50% of the width of the first strip portion 134.

One advantage of the continuous closure assembly 128, including a first strip portion 134 and a second strip portion 136 forming a cover, as described and shown in FIGS. 2A-D, is that because the second strip portion 136 is joined to the first strip portion, it may only require securing the first strip portion 134 to the respective edges of the opposing shells.

Figure 3A:
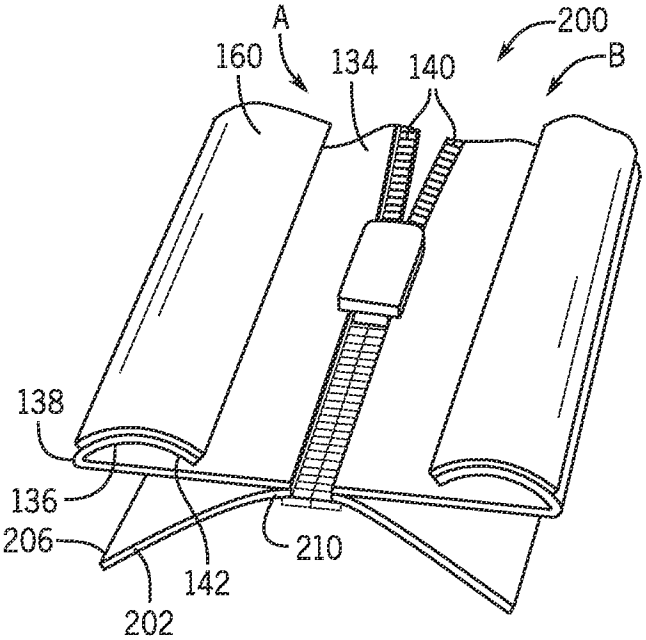
FIG. 3A shows a perspective view of a continuous closure assembly according to some examples of the present disclosure.
Figure 3B:
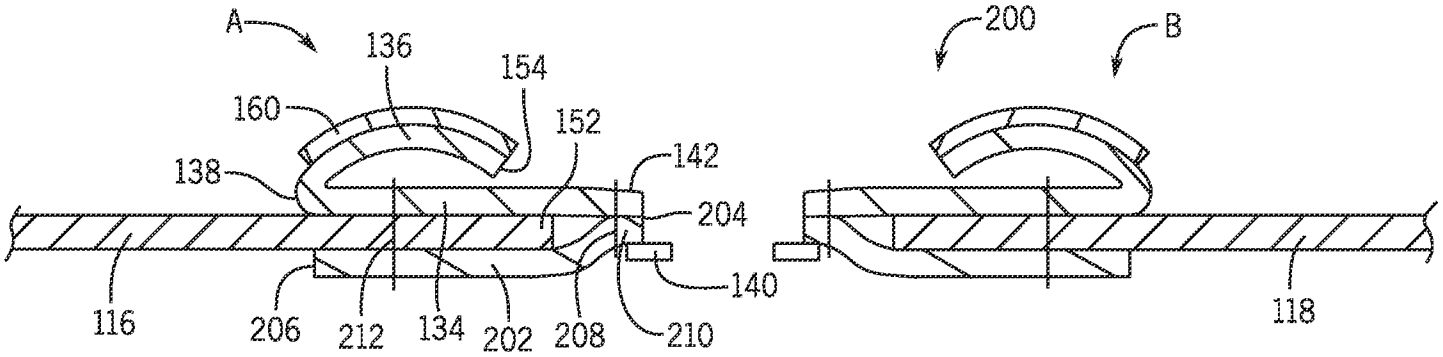
FIG. 3B shows a section view of a continuous closure assembly according to some examples of the present disclosure, taken along line 3B-3B of FIG. 3C.
Figure 3C:
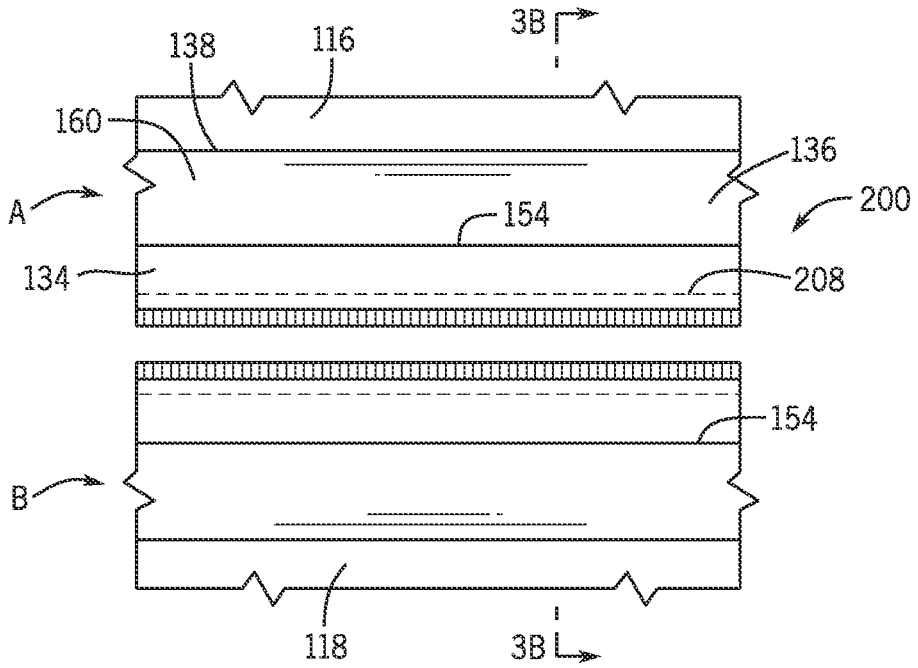
FIG. 3C shows a continuous closure assembly according to some examples of the present disclosure.

FIGS. 3A-3C show another example of the continuous zipper closure assembly 200 with a structure the same or similar to that shown in in FIGS. 2A-2C, and including a third elongated strip portion 202 attached to the first elongated strip portion 134, as described below. The third elongated strip portion 202 acts as a trim piece to cover the respective free edge 152 of the luggage case 116 to which each of the sides A and B of the continuous closure assembly 200 is attached.

In this example, each of sides A and B of the continuous closure assembly 200 includes a first elongated strip portion 134 and a second elongated strip portion 134 overlaying at least a portion of the width of the first strip portion 134, as described and shown in FIGS. 2A and 2B. The second strip portion 136 may include a cover material 160. Additionally, as best shown in FIGS. 3A and 3B, a third elongated strip portion 202 is attached to the inner edge 142 of the first strip portion 134, forming a second common edge 204, and extends along the width of the first strip portion towards the outer edge of the first strip portion (e.g. the first common edge 138 between the first strip portion 134 and the second strip portion 136) to an outer edge 206. The first strip portion 134 is on the outer side of the luggage case 116 and above, in FIGS. 3A and 3B, the third strip portion 202, which is inside the luggage case 116. The attachment along the second common edge 204 may be by stitching 208, as shown, or by bonding, adhesion other attachment mechanism. Alternatively, the first 134 and third 202 strip portions may be integrally formed of the same material, and the second common edge 204 may be formed by a fold (for example, see FIG. 4D), similar to the first common edge 138. Engagement features 140 (e.g. zipper coils 148) may be attached along the second common edge 204, as described and shown with respect to FIGS. 2A-2C, and are shown in this example as zipper coils attached to a bottom of inner edge 210 of the third strip portion 202.

The edge 152 of the first luggage shell 116 to which side A of the continuous closure assembly 200 is secured is covered by addition of the third strip portion 202, which provides a finished appearance. As shown in FIG. 3B, the edge 152 of the luggage shell 116 is received in the space between the first strip portion 134 and the third strip portion 202, where the second strip portion 136 is outside the luggage shell 116, the third strip portion 202 is inside the luggage shell 116, and the $2^{nd}$ common edge 204 covers the edge 152 of the luggage shell. The first 134 and third 202 strip portions may be secured to the luggage shell by a line of stitching 212. In this example the line of stitching 212 may extend through the first strip portion 134, the luggage shell 116, and the third strip portion 202 so all three layers are secured together. As shown, the line of stitching 212 through the first strip portion 134 is overlaid by the second strip portion 136. The structure of side B of the continuous closure assembly 200 is the same as or similar to that described with respect to side A.

Figure 3D:
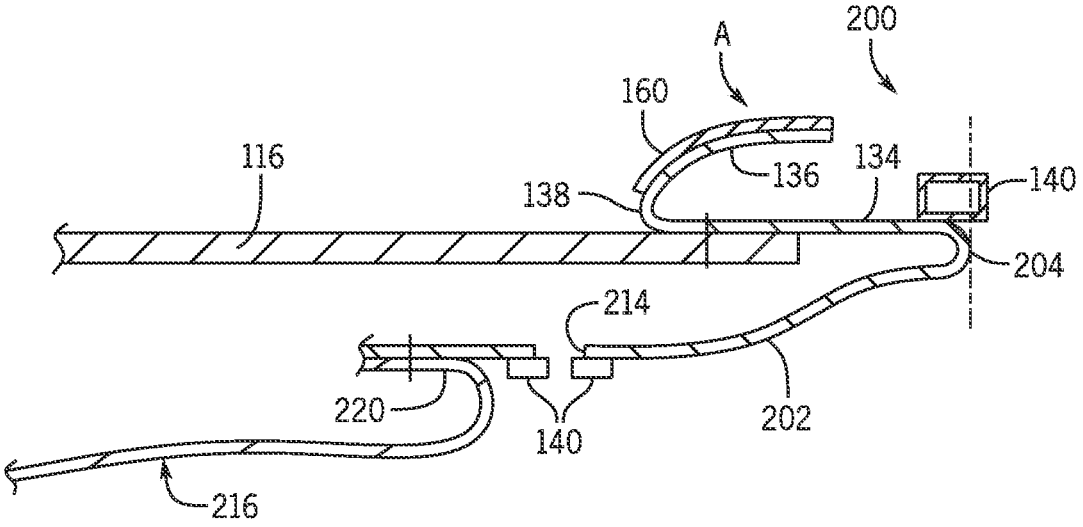
FIG. 3D shows a representative section view of a continuous closure assembly according to some examples of the present disclosure, including having an integrally formed first elongated strip and third elongated strip.

FIG. 3D shows an example the same as or similar to FIG. 3A-C, but where the outer edge 214 of the third strip portion 202 is attached to another structural feature, such as a liner member 216 for the interior of the luggage shell 116. In this example, an engagement feature 140, such as zipper coils or teeth, are positioned along the outer edge 214 of the third strip portion 202. The liner member 216 may have a corresponding engagement features 140 along a free edge 220, for example attached along with a zipper tape, which selectively connect together with the engagement features 140 on outer edge 214 of the third strip portion 202. In this manner, the liner member 216 inside shell 116 of the luggage case may be selectively secured to the interior of the luggage shell 116 for easy installation and removal. Other engagement feature types may be suitable, such as Velcro, snaps, clips, or the like.

One advantage of the continuous closure assembly 200, including a first strip portion 134, a second strip portion 136 forming a cover, and a third strip portion 202, as described and shown in FIGS. 3A-C is that because the second strip portion 136 is joined to the first strip portion, it may only require securing the first strip portion 134 and the third strip portion 202 to the respective edges of the opposing shells.

FIGS. 4A-4D show another example of a continuous closure assembly 300 including an expansion assembly 302 for a luggage case. The expansion assembly may include a primary zipper structure and an expansion zipper structure. The expansion assembly may include an elongated expansion webbing portion 304 and gusset member 306 that allows for expansion of the luggage case when desired by a user without adding significant weight, and with reduced structure and assembly complications as compared to typical expansion structures. The expansion webbing may be unreinforced. The expansion webbing may be a continuous piece of material. The expansion webbing may be a single layer of material, or may be a plurality of layers of materials. While the expansion assembly 302 is shown and described here in an example also including a continuous closure assembly, for example continuous closure assembly 128 or continuous closure assembly 200, the expansion assembly 302 as disclosed herein may also be used separately and apart from a continuous closure assembly. For example, the expansion assembly 302 may be implemented with a typical zipper structure, such as for example shown in FIG. 7B, which includes a pair of zipper tapes each with engagement features along one edge, and without having an overlying second elongated strip with or without a cover element (as in FIGS. 2A-2D or 3A-3C), and/or without having a third elongated strip (as in FIGS. 3A, 3B, 3C).

The expansion assembly 302 of this example includes an elongated webbing portion 304 having first and second opposing edges 308, 310 defining a width. A first opposing edge 308 of the webbing portion includes engagement features 140, and is configured to selectively engage with the engagement features 140 positioned on an adjacent edge 316 of a first luggage shell 116 and defines the primary closure mechanism 314 of the primary zipper structure, allowing access to the internal compartment of the luggage case. A second opposing edge 310, opposite the first edge 308, of the webbing portion 304 includes engagement features 140 configured to selectively engage with the engagement features 140 positioned on an adjacent edge 318 of the other second luggage shell 118, and defines the expansion closure mechanism 320 of the expansion zipper of the luggage case. The expansion assembly 300 also includes a gusset member 306 secured to the webbing portion 304 along a first edge 324 and operably secured, directly or indirectly, along an opposite second edge 326 to the second luggage shell 118. In some examples, the engagement features 140 are often attached to either luggage shell 116, 118 using a zipper tape 328. The second opposing edge 326 of the gusset member 306 may be attached to the zipper tape 328 (as described and shown herein), which is in turn attached to the second luggage shell 118. In another example the second edge 326 may be attached directly to the second luggage shell 118. When the expansion opening 320 is selectively opened (such as shown in FIG. 4B), disconnecting the second opposing edge 310 of the webbing portion 304 and the adjacent luggage shell 118, the expansion opening 320 increases to the width of the gusset member 306, which results in an increase in the volume of the internal compartment of the luggage case. When not intended for use, the expansion opening 320 is selectively closed, which reduces the volume of the internal compartment of the luggage case.

The webbing portion 304 may be flexible. The webbing portion 304 may be made of a woven, non-woven, knit or solid (such as a plastic strip) material. In the example described the elongated webbing portion 304 is a woven fabric material such as is commonly used for zipper tapes.

In further detail of one example, and not to be limited by the inclusion of features related to the continuous closure assembly aspects described above and that are unrelated to the expansion assembly, the expansion assembly 302 is defined with respect to structure shown in FIGS. 2A-2C. In this example, the first elongated member 130 and the second elongated member 132 may be the same as or similar to that shown and described above with respect to FIGS. 2A-2C, with the elongated expansion assembly 302 additionally positioned between the first and second elongated members 130, 132, respectively.

Figure 4A:
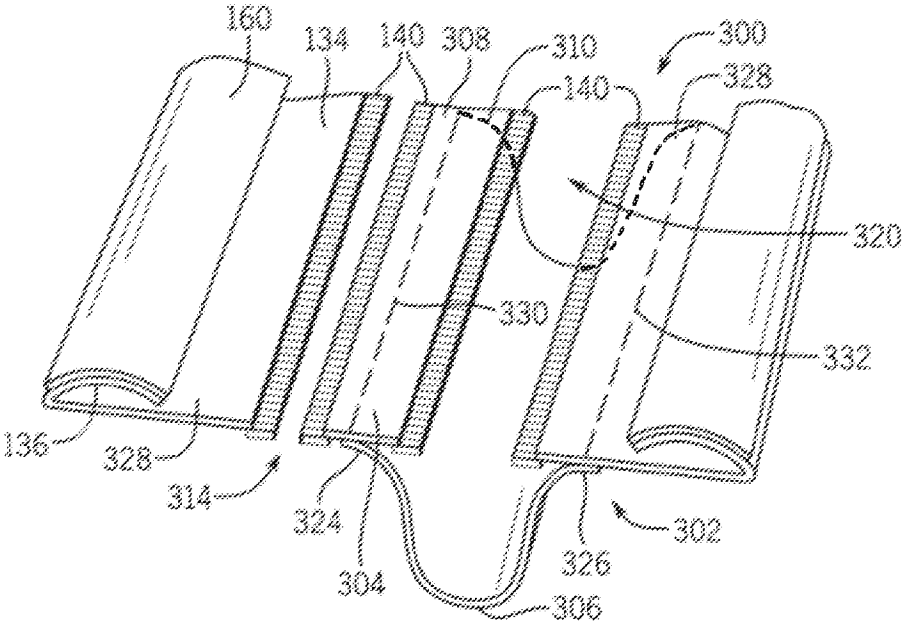
FIG. 4A shows a perspective view of a continuous closure assembly according to some examples of the present disclosure.
Figure 4B:
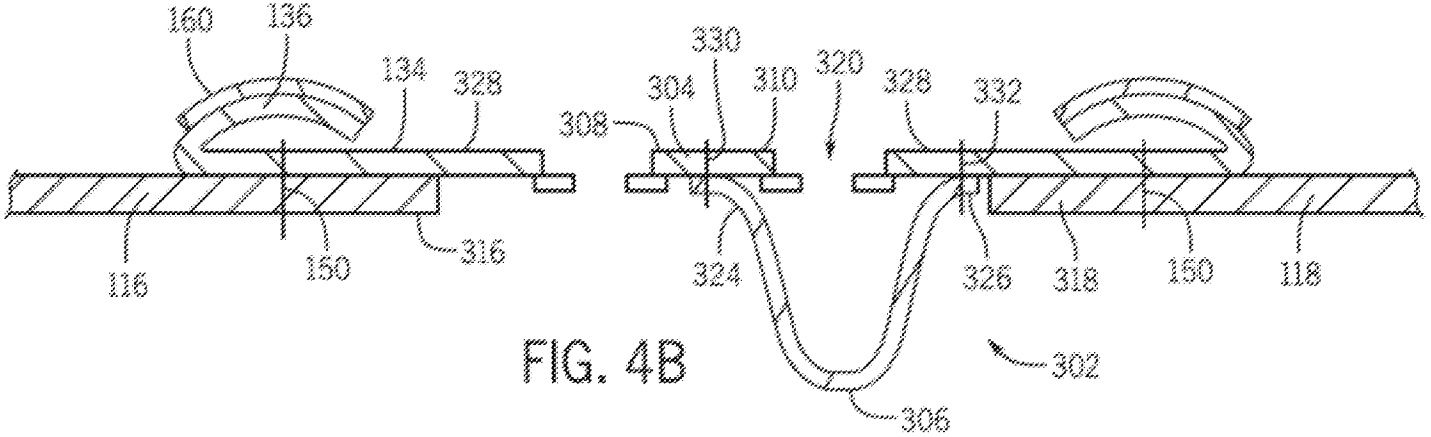
FIG. 4B shows a section view of a continuous closure assembly according to some examples of the present disclosure, taken along line 4B-4B of FIG. 4D.

Continuing with FIGS. 4A and 4B, the expansion assembly 302 is positioned between the opposite sides A and B of the continuous closure mechanism 128 from FIGS. 2A-2C, and in a partially expanded configuration. The zipper coils 148 along the first edge 308 of the webbing portion 304 are configured to engage with the adjacent zipper coils on side A of the continuous closure 128, which forms the primary closure mechanism 314 controlling the opening and closing of the luggage case. The zipper coils on the opposite side 310 of the webbing portion 304 are configured to engage with the adjacent zipper coils on side B of the continuous closure 128, which forms the expansion closure mechanism 320 whether or not the expansion feature is deployed.

As shown in FIGS. 4A and 4B, the gusset member 306 is attached along one edge 324 to the webbing portion 304, such as by a line of stitching 330, and at an opposite edge 326 to the first elongated strip portion 134, such as by a line of stitching 332, on side B of the continuous closure assembly 128. The gusset member 306 may be flexible in order to reduce in size when not in use, and may be made of one or more than one layer of woven, non-woven, knit or solid (such as a plastic strip) material. The gusset member 306 may have characteristics, similar to or the same as, the cover material 160 positioned on the second strip portion 136 described and shown above in FIGS. 2A-2C, to improve or enhance its wear and/or water resistance.

Figure 4C:
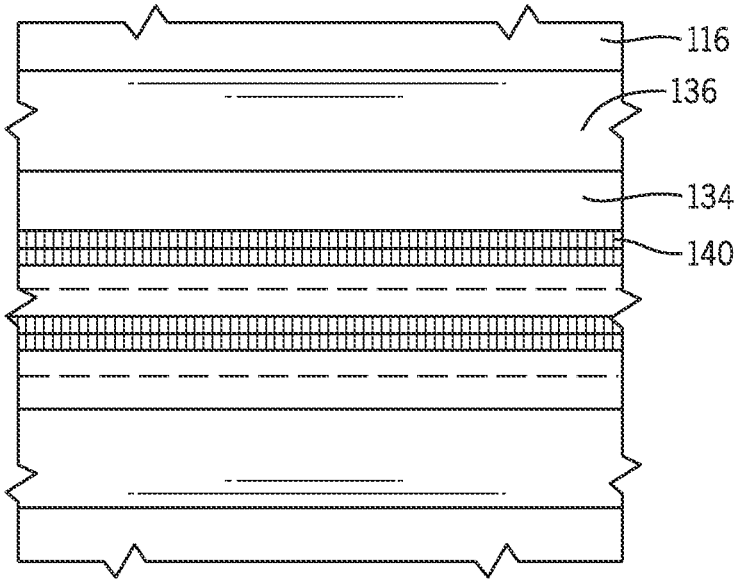
FIG. 4C shows a plan view of a continuous closure assembly according to some examples of the present disclosure, showing the expansion zipper in a closed configuration.
Figure 4D:
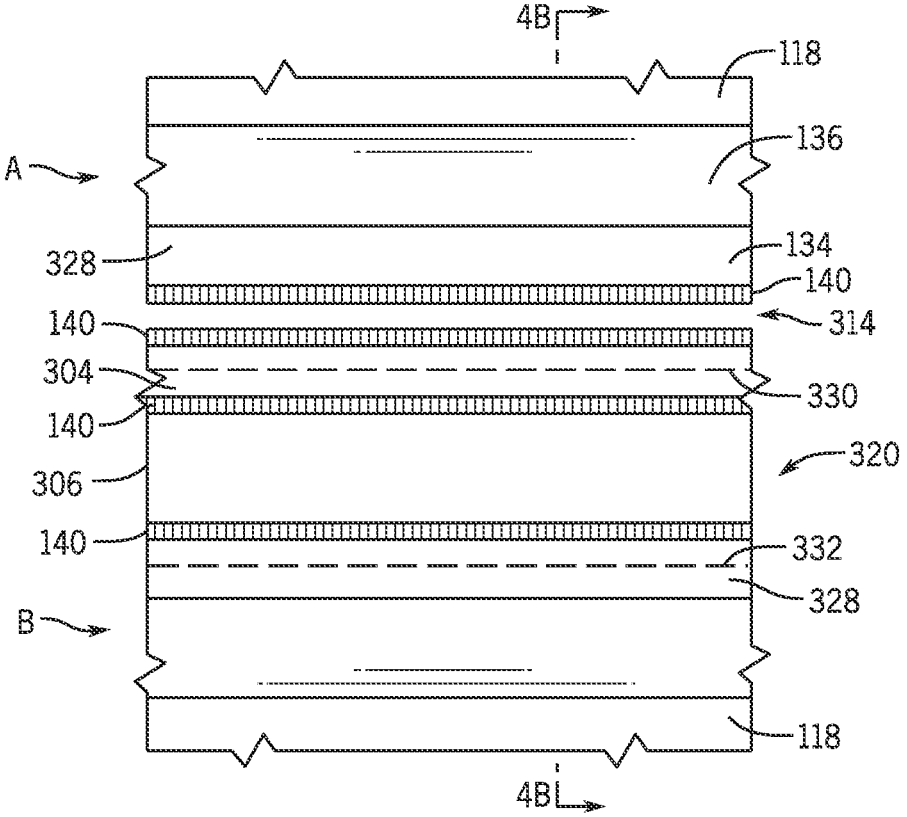
FIG. 4D illustrates a plan view of a continuous closure assembly according to some examples of the present disclosure, showing the expansion zipper in an open configuration.

The expansion assembly 302, when implemented, allows the volume of the luggage case to be selectively increased by an amount determined by the width of the gusset member 306. As shown in FIG. 4C, the primary zipper closure 314 is shown in a closed configuration. The expansion zipper closure 320 is in the closed configuration, with stitching line 330 showing where the gusset member is attached to the webbing portion, and stitching line 332 showing where the gusset member 306 is attached to the first strip portion 134 of side B of the continuous closure assembly. The gusset member 306 may be flexible, and when in the closed configuration the width of the gusset member is folded or collapsed between the two stitching lines 330 and 332 (similar to FIG. 4B). In FIG. 4D the expansion zipper is shown in an open configuration with the gusset member 306 expanded, similar to but wider than FIGS. 4A and 4B.

Figure 5A:
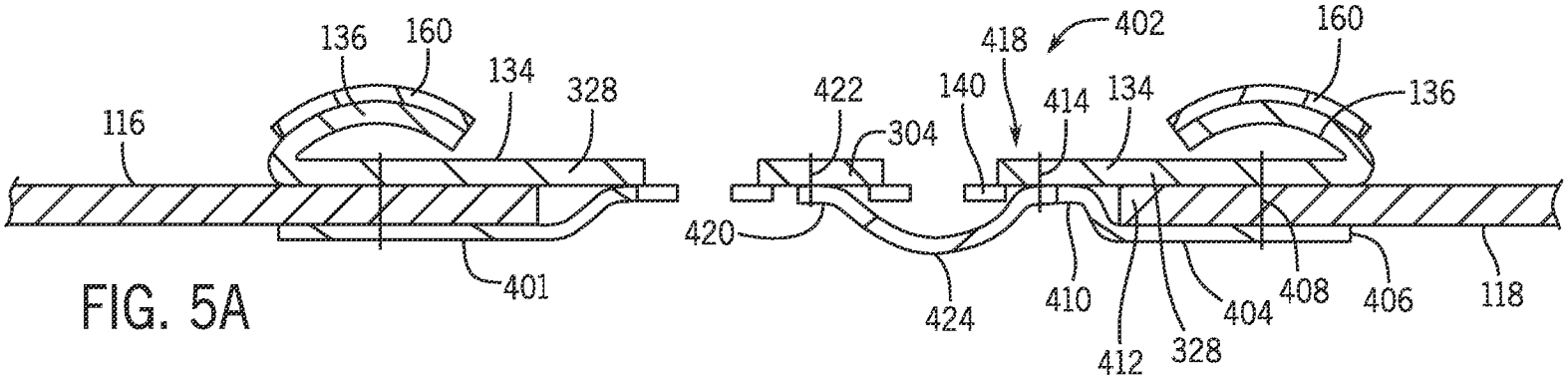
FIG. 5A shows a section view of a continuous closure assembly according to some examples of the present disclosure, taken along line 5A-5A of FIG. 5B.
Figure 5B:
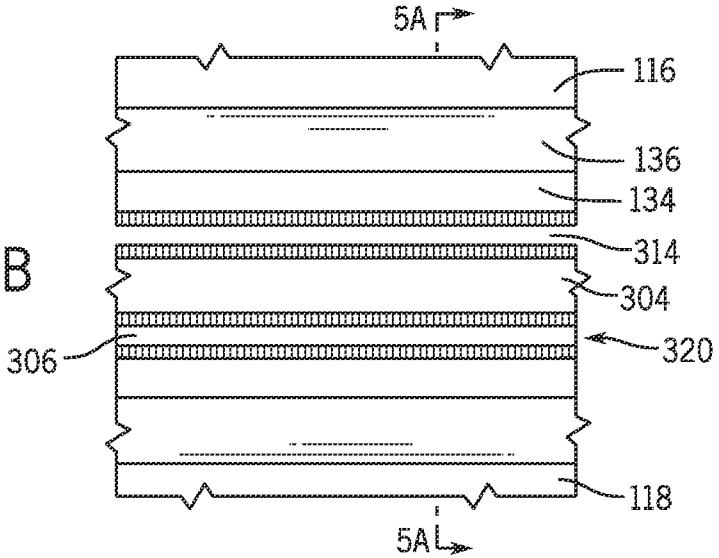
FIG. 5B shows a rear plan view of a continuous closure assembly according to some examples of the present disclosure.

Another example of the expansion assembly 402 is shown in FIG. 5A. This example includes structure that is the same as or similar to that shown in FIGS. 4A-4C, with the addition of a third elongated strip portion 404 extending inside the luggage shell 118, and including a portion forming the gusset member 306. As with FIGS. 4A-4C, this example of the expansion assembly may be utilized with a zipper closure different than the continuous closure assembly, such as those shown and described with respect to examples in FIGS. 2A-2C, and 3A-3D, having an overlying second strip portion 136. In this example, the third elongated strip portion 404 may have a width dimension to extend from below (in the orientation of FIG. 5A) the first strip portion 134 to below the webbing portion 304. The third strip portion 404 may attach at one outer edge 406 to the shell and the first strip portion 134, such as by an outer line of stitching 408 securing at least these three components together. Alternatively, the first strip portion 134 may be in the form of a simple zipper tape 328 (such as for example shown in FIG. 7B), which does not have the second strip portion 136 overlying the first strip portion 134. A middle portion 410 of the third strip portion 404 may be secured at or near the inner edge 142 of the first strip portion 134 (or simple zipper tape 328), between the free edge 412 of the shell 118 and the engagement elements (e.g. zipper coils) 140. This attachment may be by a central line of stitching 414. The engagement of the first strip portion 134 (or simple zipper tape 328 such as for example shown in FIG. 7B) and the third strip portion 404 defines a second common edge 418. An inner edge 420 of the third strip portion 404 may attach to the webbing portion 304, such as for example by an inner line of stitching 422. The width dimension of the third strip portion 404 defined between the central line of stitching 414 and the inner line of stitching 422 defines the gusset member 424, which may be similar to gusset member 306. The expansion gusset member 424 may be flexible, as described and shown above with respect to gusset 306 of FIGS. 4A-C.

The width of the gusset member 424 is greater than the dimension between the central 414 and inner 422 lines of stitching when the expansion zipper is closed. In this closed configuration the gusset member 424 is folded or gathered in the interior volume of the luggage case. As with the expansion assembly 300 of FIGS. 4A-C, when the expansion zipper 320 is disengaged engaged, the luggage shells 116 and 118 may move apart by the amount of the width of the gusset member 414, allowing the interior volume of the luggage case to expand. The edge 412 of the luggage shell 118 may be received between the first 134 (or simple zipper tape 328) and third 404 strip portions, with the first strip portion 134 on the outside of the luggage shell, and the third strip portion 404 on the inside of the luggage shell, together forming a trip piece, with the edge 412 of the luggage shell 118 enclosed and covered.

The engagement elements 140 of the expansion zipper 320 may be attached at the bottom of the inner edge of the first strip portion 134 (as shown in FIG. 5A), the top inner edge, or both as desired, with corresponding zipper coils located on the corresponding edge of the expansion webbing 304. Where upper and lower zipper coils are used, a single zipper slider configured to engage and disengage both the upper and lower zipper coils may be utilized. Alternatively, a separate zipper slider for each of the upper and lower zipper coils may be implemented.

Figure 6A:
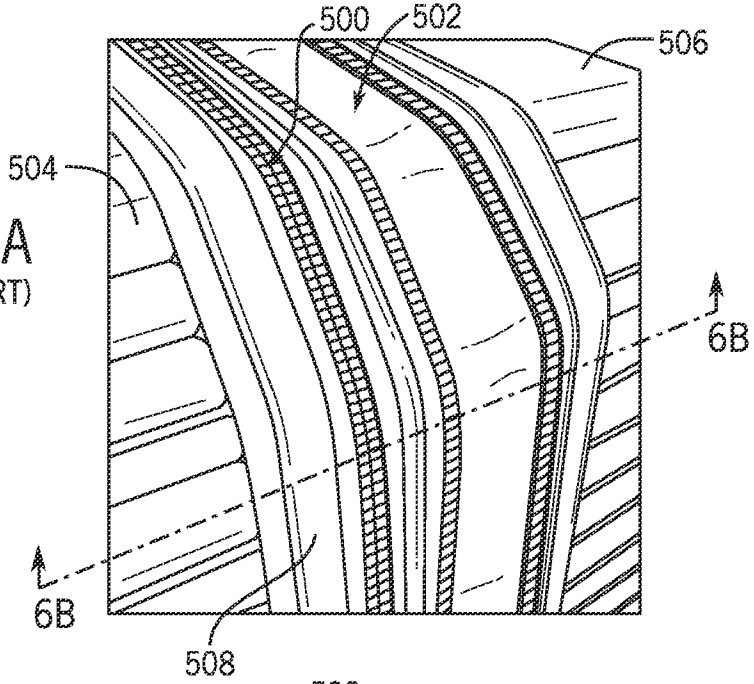
FIG. 6A (PRIOR ART)
FIG. 6A (Prior Art) shows a partial perspective view of a typical extruded zipper cover and a typical expansion zipper structure.
Figure 6B:
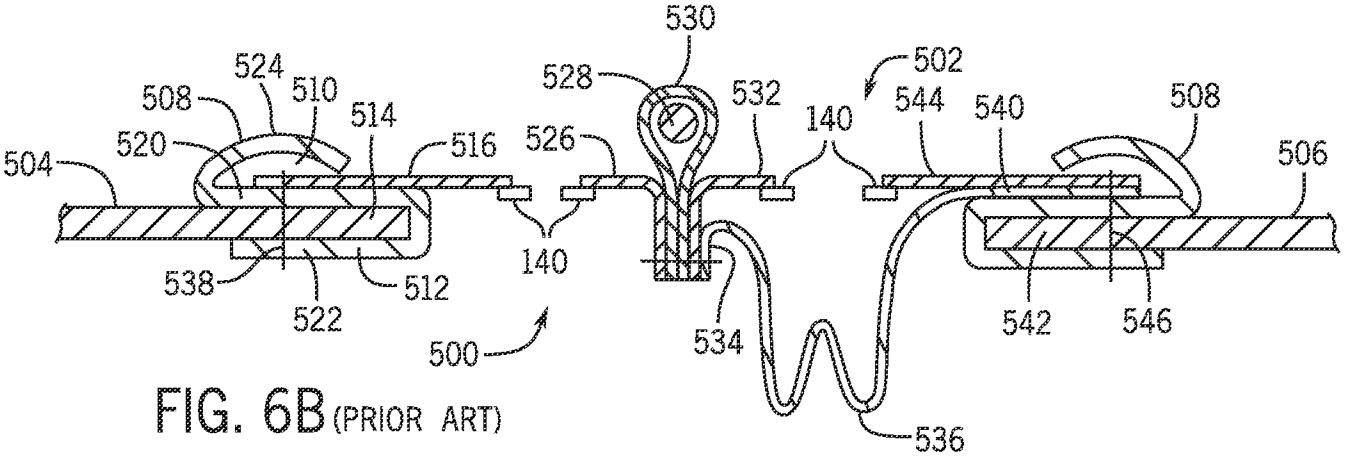
FIG. 6B (PRIOR ART)
FIG. 6B (Prior Art) shows a section view taken along line 6B-6B of FIG. 6A.

To highlight the distinction and benefits of the expansion zipper assembly examples of the present disclosure compared to a typical expansion zipper structure, refer to FIGS. 6A and 6B. FIGS. 6A and 6B show a typical structure of a primary zipper 500 (for opening the luggage case) and an expansion zipper structure 502 (for expanding the luggage case) known in the prior art. FIG. 6A is a partial perspective view, and FIG. 6B is a section view taken along line 6B-6B of FIG. 6A. In FIGS. 6A and 6B, two luggage shells 504 and 506 of a luggage case have a primary zipper 500 and an expansion zipper 502. A typical protective cover for a zipper structure may be in the form of an S-shaped extrusion 508. The S-shape extrusion 508 defines two recesses 510, 512 with openings facing in opposite directions, with an edge 514 of the corresponding luggage shell being received in the lower recess 510, and the zipper tape 516 being received in the upper recess 512. The extrusion 508 is secured to the luggage case by a line of stitching 518 extending through the zipper tape 516, and top 520 and bottom 522 walls bounding the bottom recess 510, as well as the respective shell portion received in the bottom recess 510. In using the extrusion 508 as a cover structure, the assembly requires placing the extrusion 508 on the luggage shell, placing the zipper tape 516 in the upper recess, aligning the components together, folding back the top layer 524 of the extrusion, and sewing the four layers together.

By comparison, the zipper cover structures as described and shown in FIGS. 2A-D and 3A-C may only require securing the first strip portion 134 to the respective edges of the opposing shells, and does not require any alignment of multiple parts to then be secured to the respective luggage shells.

Regarding the typical expansion zipper structure, and continuing with FIGS. 6A and 6B, the primary zipper 502 has one zipper tape 516 attached to the corresponding shell within a traditional S-shaped extrusion 508. The opposing zipper tape 526 of the primary zipper 500 is part of an assembly of multiple subcomponents forming part of the known expansion zipper structure 502, including a wire-reinforcement 528 in a bead housing 530, one zipper tape 532 for the expansion zipper 502, and one end 534 of the expansion gusset 536. The zipper tapes 516, 526, and 532 referred to regarding FIGS. 6A and 6B may include engagement features 140, such as zipper coils. Each of these subcomponents are secured together, such as by a line of stitching 538. An opposite end 540 of the gusset member 536 may be secured to the rim 542 of the other shell 506, together with two layers of the extrusion 528, and zipper tape 544, by a line of stitching 546. The assembly of this typical expansion zipper structure 502 is complicated and expensive due to the fact that use of the multiple subcomponent assembly must itself be assembled, including the steps of making each separate subcomponent, aligning the subcomponents, and securing the subcomponents together. Additionally, the subcomponent assembly may require pre-bending of the wire reinforcement 528 and bead housing 530 at the proper locations to fit the size of the luggage case to which it is applied before being assembled onto a luggage case. The above factors associated with the typical expansion zipper structure 502 greatly impact, and make more expensive, the cost of component parts and the cost and complication of assembly of a luggage case with an expansion capability. Additionally, given the inclusion of the several subcomponents and the wire reinforced beading, the typical expansion zipper 502 structure weighs a significant amount. For example, some typical expansion structures may weigh as much as about 141 grams per meter or more. The additional weight may be problematic both in the commercial appeal and functional use by the ultimate user.

By comparison, as described and shown in the examples of FIGS. 4A-4D, and FIGS. 5A-5B, the expansion assembly of the present disclosure is more simple to assemble, much simple to attach onto a luggage case, and may weigh significantly less than the typical expansion zipper structure. In fact, in some examples, the expansion assembly as described and shown herein, may weigh approximately 62.5 grams per meter, which may be significantly less, and may be less than half of the weight per meter of the typical expansion zipper structure. As noted above, in comparison to the subcomponent assembly of FIGS. 6A and 6B, the webbing portion of the present disclosure may be as simple as an elongated flexible strip of material, such as that typically used for zipper tape. The webbing portion may have opposing sides, each defining engagement features (e.g. zipper coils) therealong. One edge of the expansion gusset is secured to the central region of the webbing portion, such as by a line of stitching. The webbing portion may be un-reinforced, and not include any stiffening structure in the webbing portion. Also, as referenced above with respect to FIGS. 4A-D, and FIGS. 5A-B, the expansion assemblies, 300 and 402, respectively, may be secured to the opposing luggage shells by attaching the opposing first strip portions 134 (or simple zipper tapes 328 if in that form) on either side of the expansion assemblies 300, 402 to their respective luggage shells 116, 118. In some examples the opposing first strip portions may be secured to their respective luggage shells 116, 118 by a line of stitching. Because the gusset member is attached between the expansion webbing and the first strip portion (or simple zipper tape 328 if in that form), an edge of the gusset member does not need to be attached to the edge of one of the two luggage shells, which simplifies assembly and reduces costs.

Additionally, in the expansion zipper assembly as described and disclosed herein, the overall width is less than the typical expansion zipper structure, which reduces or eliminates the need for the more complicated, expensive, and heavy wire beading element. Additionally or separately, the expansion zipper assembly may be joined to the edge of the luggage case as simply as attaching the first and second zipper tapes to the respective first and second shells. Accordingly, a lighter luggage article having an expansion feature and assembled using fewer assembly steps may be provided.

In some implementations, at least a portion of the primary zipper 602 and expansion zipper structure 604 may be covered by a hinge 606. While the primary and expansion zipper structures are shown in FIGS. 7A-D as incorporating the continuous closure assembly in the form of the expansion assembly (such as those in FIGS. 4A-D, and 5A-D), it is shown without the implementation of the continuous closure assembly having a cover (such as shown and described in FIGS. 2A-D and 3A-D). In other examples, the structure described and shown in 7A-D may be implemented along with the continuous closure structure assembly having a cover, and with or without the continuous closure structure in the form of the expansion assembly.

Figure 7A:
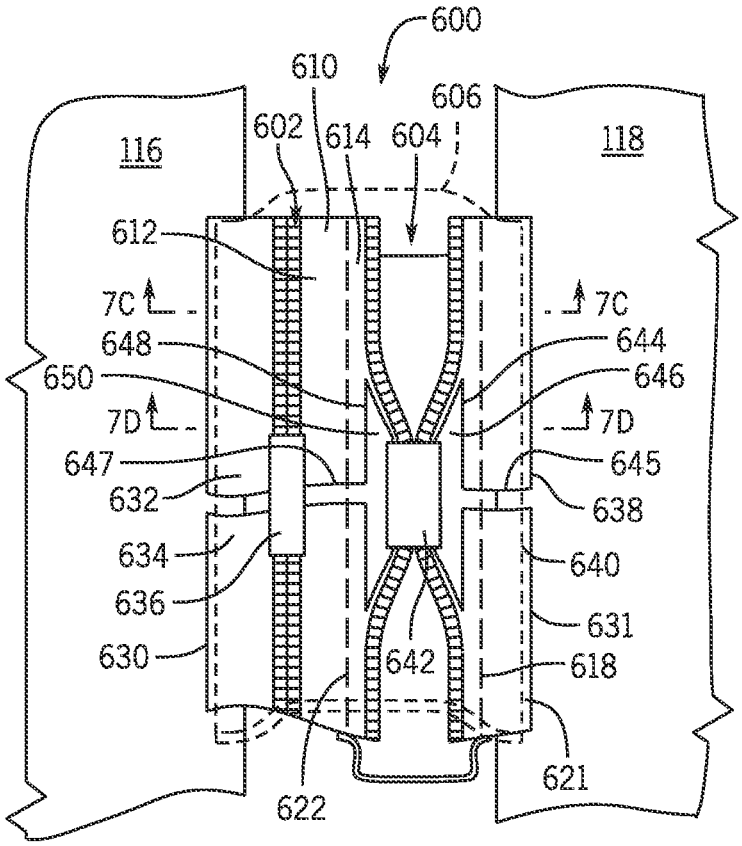
FIG. 7A shows a plan view of a continuous closure assembly according to some examples of the present disclosure.
Figure 7B:
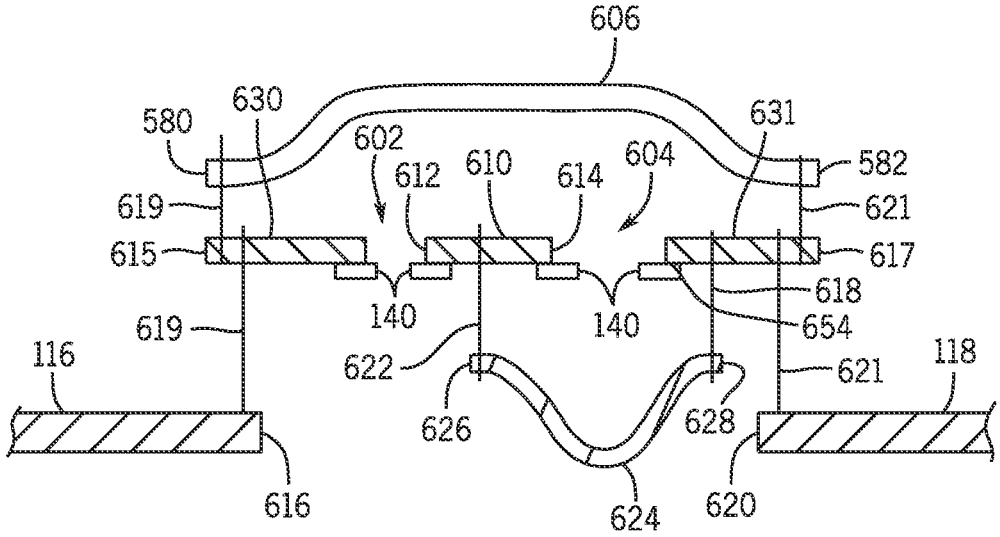
FIG. 7B shows an exploded section view of a FIG. 7C.

The general structure of the example in FIGS. 7A-E of the expansion zipper assembly 600 is shown in FIG. 7B, and is described herein below. This example is the same or similar in many ways to the expansion zipper assembly described and shown in FIGS. 4A-D and 5A-C. One difference is that the first elongated strip portions of the elongated strip members in this example are in the form of simple zipper tapes 630, 631, instead of the elongated strip portions including a first strip portion in combination with at least an overlying second strip portion. The expansion zipper assembly 600 of this example includes an elongated webbing portion 610 having first 612 and second 614 opposing edges defining a width. The first opposing edge 612 of the webbing portion 610 includes engagement features 140, and is configured to selectively engage with the engagement features 140 joined to adjacent edge 616 of a first luggage shell 116 and defines the primary zipper closure mechanism 602 to the internal compartment of the luggage case. The second opposing edge 614, opposite the first edge 612, of the webbing portion 610 includes engagement features 140 configured to selectively engage with the engagement features 140 positioned on an adjacent edge 620 of the other second luggage shell 118, and defines the expansion zipper closure mechanism 604 of the luggage case. The expansion assembly 600 also includes a gusset member 624 secured to the webbing portion 610 along a first edge 626, such as for example by a line of stitching 622, and operably secured, directly or indirectly, along an opposite second edge 628 to the second luggage shell 118. In some examples, the engagement features 140 are often attached to either luggage shell 116, 118 using a zipper tape 630, 631, respectively. The second opposing edge 628 of the gusset member 624 may be attached to the zipper tape 630 by a line of stitching 618 (as described and shown herein), which is joined to the second luggage shell 118. In another example, the second edge 628 may be attached directly to the second luggage shell 118 and not first to the zipper tape 631. When the expansion zipper 604 is selectively opened (such as shown in FIG. 7A), separating the second opposing edge 614 of the webbing portion 610 from the adjacent luggage shell 118, the expansion zipper 604 may increase to a partial or full extension of the gusset member 624, which results in an accordant increase in the volume of the internal compartment of the luggage case. When not intended for use, the expansion zipper 604 is selectively closed, which reduces the volume of the internal compartment of the luggage case.

The hinge 606 may define first 580 and second 582 edges that are each coupled to a shell 116, 118, respectively. The hinge 606 may be expandable to allow the luggage case to change from the unexpanded position to the expanded position and provide the function of the hinge in either position. The hinge 606 may be made, for example, of an expandable material, such as elastic, and may include one or more layers. The hinge 606 may attach directly to the shell 116 and shell 118 or may be attached to the shell 116 and shell 118 indirectly through attachments to various layers and or other intervening components.

As shown in FIG. 7A, an expansion assembly 600 is shown attaching a first shell 116 and a second shell 118, with a hinge 606 (in dash) positioned over the expansion assembly and joined along opposing edges to the first shell 116 and the second shell 118. The expansion assembly 600 includes a primary zipper structure 602 and an expansion zipper structure 604 having features similar to or the same as defined above, at least with respect to FIGS. 4A-C and FIGS. 5A-B. The expansion assembly 600 includes primary zipper closure structure 602 defined by a first outer zipper tape 630 on the first shell 118 and a first edge 612 of a central webbing portion 610. The expansion zipper assembly 600 also includes an expansion zipper structure 604 formed by a second outer zipper tape 631 on the second shell 118 and with the second edge 614 of the central webbing portion 610. The central webbing portion 610, as described above with respect to FIGS. 4A-C, and 5A-B, has engagement features, such as zipper teeth, along each of its opposing edges 612, 614.

The hinge 606, as shown in FIGS. 7A and 7B, is secured along opposing sides 580, 582 to the respective shells 116 and 118 near or adjacent to the outer edges 615, 617, respectively, of the first outer zipper tape 630 and the second outer zipper tape 631 by lines of stitching 619, 621. In another example, a single line of stitching on both sides may be used. Each zipper tape 630, 631 and the central webbing 610 is approximately 18 mm wide, so in the unexpanded configuration, the expansion zipper assembly 600 is approximately 54 mm wide (3×18 mm). The unexpanded width of the hinge 606 may be, for example, approximately 54 mm wide in its baseline unexpanded state. When the expansion zipper structure 604 is in the open configuration and the expansion gusset member 624 is extended, in one example the expansion gusset member 624 allows for 30 mm of expansion distance, which is a typical amount of expansion. This amount of expansion requires the hinge to accommodate a 30 mm increase in baseline unexpanded dimension, or approximately 55% of is unexpanded baseline width. This amount of expansion does not excessively wear the hinge material, allowing it to retain its resilience over many cycles of expanding and contracting. This is an improvement over typical hinge structures that have an unexpanded baseline width of approximately 18 to 20 mm and with the same amount of expansion (30 mm) are required to expand approximately 150%, which may wear out the resiliency of the hinge materials relatively quickly.

Figure 7C:
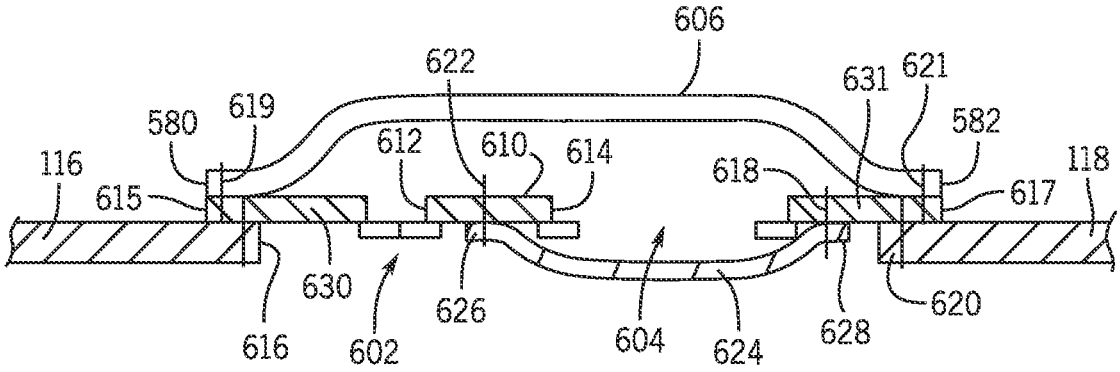
FIG. 7C illustrates a section view of a continuous closure assembly according to some examples of the present disclosure, taken along line 7C-7C of FIG. 7A.
Figure 7D:
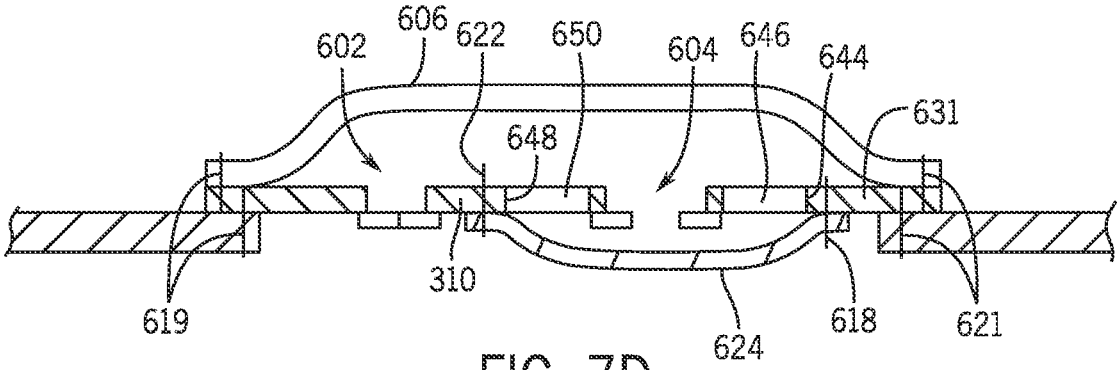
FIG. 7D illustrates a section view of a continuous closure assembly according to some examples of the present disclosure, taken along line 7D-7D of FIG. 7A.

Also with respect to FIGS. 7A-7D, examples are provided of the structure for terminating the ends of the expansion zipper assembly 600. FIG. 7A shows the terminal ends of the zipper coils of the primary zipper structure 602 and expansion zipper structure 604. The termination structure accommodates the operation of the expansion zipper assembly between its closed, and open and expanded configurations. The open and expanded configuration is shown in FIGS. 7A, 7C and 7D.

The termination structure of the expansion zipper 604 defines the end of travel of the slider along the zipper structure 604, and accommodates both the closing of the expansion zipper 604 and the widest extension of the gusset member 624 when in an expanded configuration. The primary zipper 602 and the expansion zipper 604 both define opposing ends. The opposing ends 632, 634 of the primary zipper 602 are positioned adjacent one another on the luggage case, and each opposing end is secured in an engaged configuration by a retention clip 636. In one example the opposing ends are retained in the same retention clip, but may be retained by separate retention clips. The opposing ends 638, 640 of the expansion zipper 604 are positioned adjacent one another on the luggage case, and each opposing end is secured in an engaged configuration by a retention clip 642. In one example the opposing ends are retained in the same retention clip, but may be retained by separate retention clips.

As shown in FIG. 7A, when the expansion zipper 604 is in the open and expanded configuration, a slit 644 may be formed in the terminal end portion 645 of the zipper tape 631 on one side of the retainer clip 642. A slit 648 may also be formed in the terminal end portion 647 of the webbing portion 610 on the other side of the retainer clip 642. The slits 644, 648 each form a split-line that allows the respective material on either side of the slit 644, 648, respectively, to move relative to one another. For example, the slits 644, 648 each are configurable into a closed position where the respective material on either side of the slit are engaging or closely adjacent and no gap is formed. In another example, the split-line of slit 644 may separate to form a gap 646, and the split line of slit 648 may separate to form a gap 650, when under a lateral force pulling them apart, such as when the expansion zipper 604 is in the expanded configuration shown in FIGS. 7A and 7D. The slits 646, 648 formed on either end of the side of the retention clip 636, 642, respectively, at the terminal end 638 of the expansion zipper 604 divides the amount of expansion of the slits 636, 642 relatively equally between the pair of slits. The slits 644, 648, by allowing the gaps 646, 650 to form, reduce a lateral separating force, such as from configuring the expansion zipper 604 in the open and expanded state, from unduly straining the portion of the expansion zipper 604 within the retention clip 642. In another example a slit may be formed on only one side of the retention clip 642, which may need to be longer than the length of two slits, to form a gap sufficiently sized to accommodate the extension of the gusset member 624 when expanded.

The location of the slits 644, 648 are shown in one example in FIGS. 7A and 7D. The slit 648 in the zipper tape 630 is formed between the engagement features and the line of attachment 618 between the second edge 628 of the gusset member 624 and the zipper tape 631. The slit 648 in the webbing portion 610 may be formed between the engagement features on the second edge 614 of the webbing portion 610 and the line of attachment 622 between the first edge of the gusset member 624 and the webbing portion 610. The slits may be linear, resulting in a V shape when expanded, or may have another shape. The length of each slit may be sufficient to allow each slit to expand sufficiently to adjust for the fully expanded width of the gusset member 624. In some examples, the slit may have a length and a width (when the expansion zipper is open and the gusset member is expanded) that are approximately the same. In one example the slit may be approximately 0 mm to 40 mm long, and may allow the formation of a gap having a width of 0 mm to 40 mm. The slits may be of different lengths. The slit structure as described, in another example, may be applied to the other end of the expansion zipper 604 as shown in FIG. 7A. The slit structure is simple, reliable, and provides the relative movement beneficial for the operation of the expansion assembly 600.

Figure 7E:
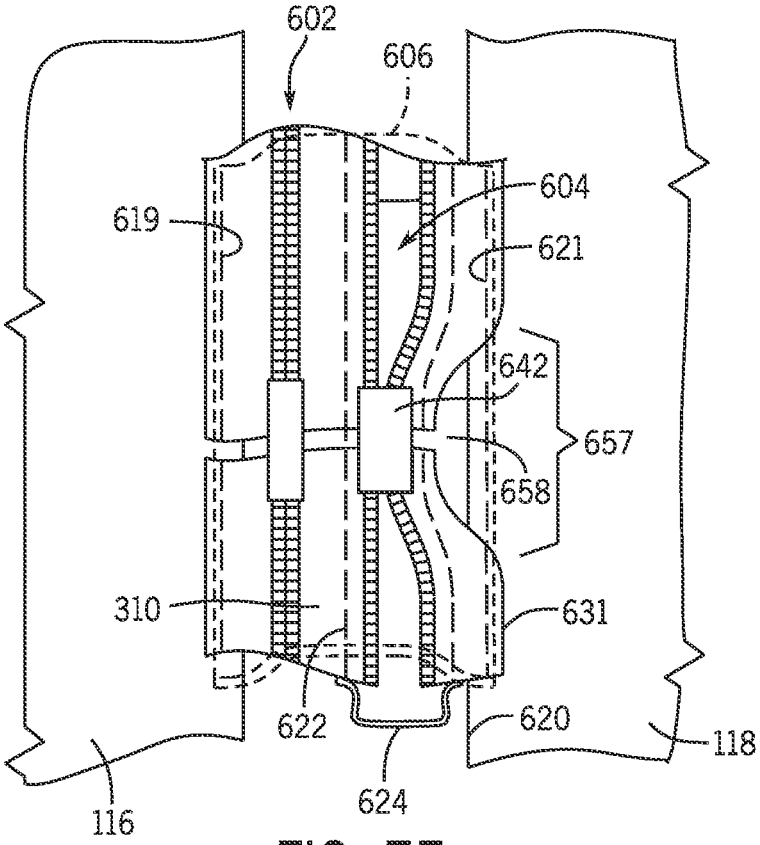
FIG. 7E shows a plan view of a continuous closure assembly according to some examples of the present disclosure.

With reference to FIG. 7E, in another example the deflection, due to expansion of the gusset member 624, of the zipper tape 631 is accommodated on one side of the retention clip 642. As shown in FIG. 7E, the zipper tape 631 is joined to the edge 620 of the second shell 118 along much of its length, but in the region 657 near the retention clip 642, the zipper tape 31 is not attached to the edge 620 of the second shell 118, and instead is free from and movable relative to the second shell 118. The zipper tape 631 in this region, for example, may not be secured to the second shell 118. This localized detachment in region 657 allows the zipper tape 630 to move away from the edge 620 of the second shell 118, forming a gap 658, when the expansion zipper 604 is open and the gusset member 624 is expanded partially or fully. This example may apply also to the other opposing end of the expansion zipper 604.

Figure 8:
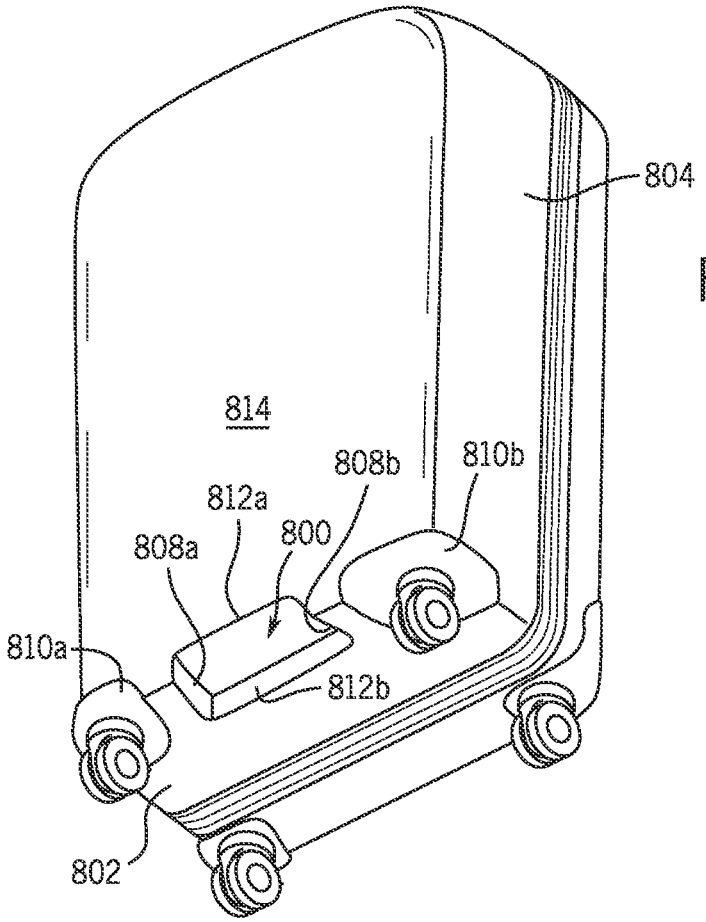
FIG. 8 shows a bottom quarter view of a luggage case according to some examples of the present disclosure.
Figure 9:
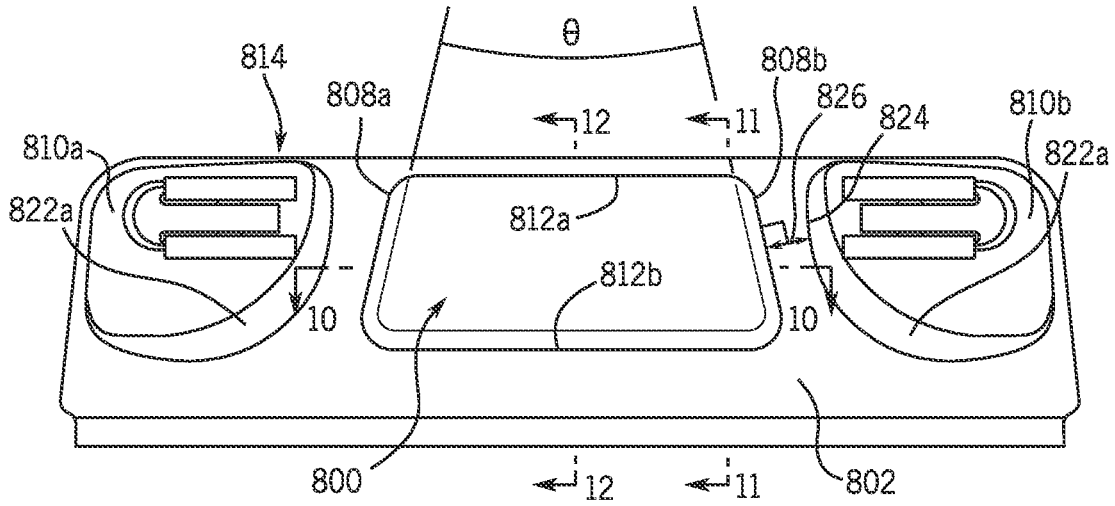
FIG. 9 shows a bottom view of the luggage case of FIG. 8.
Figure 10:
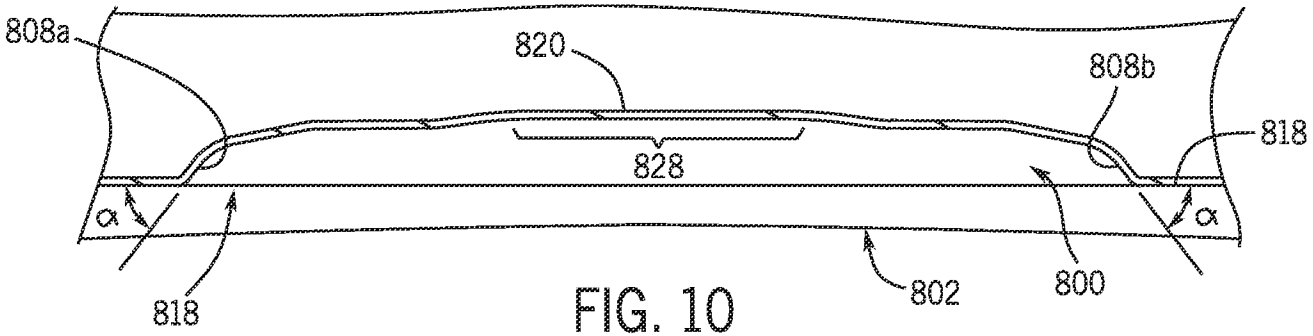
FIG. 10 shows a section taken along line 10-10 of FIG. 9.
Figure 11:
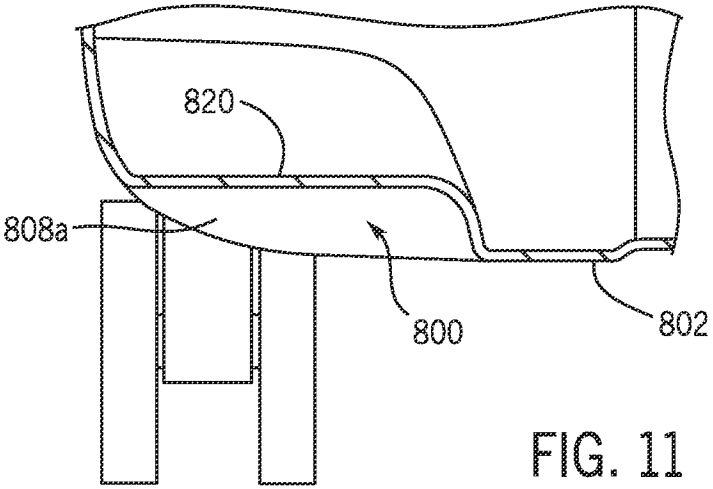
FIG. 11 shows a section taken along line 11-11 of FIG. 9, which is near an end portion of the recess.
Figure 12:
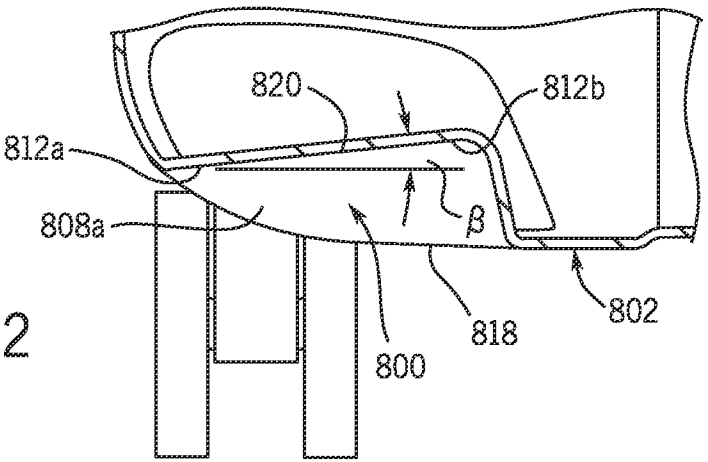
FIG. 12 shows a section taken along line 12-12 of FIG. 9, which is a central portion of the recess.

The stiffness of the luggage case, including the stiffness of the bottom panel, may in some instances be affected by the implementation of the expansion zipper structure as described herein. For instance, the edges of the front and rear shells, such as along the bottom panel, may deflect or "sag" when the luggage case is fully loaded and resting on its wheels. To reduce this sag or deflection, the stiffness of the bottom panel may be improved, where desired, by the formation of at least one recess in a bottom portion of the luggage case. A recess may be formed in a bottom panel of each of, or only one of, the front and rear shells making up the luggage case. Referring to FIGS. 8 and 9, a recess is shown formed in the bottom panel 802 of the front shell 804 of the luggage case 806. The luggage case 806 may be similar to or the same as the luggage case shown in FIG. 1. It may include, but is not required to include, the continuous closure assembly described herein, including closure assemblies 200, 300, 400, 500, 600, or 700. The recess 800, as shown in FIGS. 8 and 9, is generally trapezoidal in shape, with a long dimension (width) extending laterally between opposing end walls 808*a* and 808*b*, each adjacent to a wheel well 810*a*, 810*b*, respectively. The recess 800 has a relatively shorter dimension (depth), as best shown in FIGS. 12 and 13, extending from a front edge 812*a* adjacent a major face 814 to a rear wall 812*b* adjacent to the rim 816 of the front shell 804. The recess 800 has a height dimension (height), as best shown in FIGS. 10 and 11, defined from the nominal bottom panel 818 to a top wall 820 of the recess 800. The shape of the recess 800 affects the stiffening enhancements that it provides.

In general, the recess 800 may include 4 different features that individually or in any combination may enhance the stiffness of the bottom panel 802 in which the recess 800 is formed. These four features include a trapezoidal shape, proximity of the end walls 808*a,b* of the recess 800 to a curved wall of respective wheel housing recess 810*a,b*, the arcuate-shaped top wall 818, and the undercut angle at a central portion of the top wall 820.

More specifically, with reference to FIG. 8, each of the opposing end walls 808*a,b* extend between the rear wall 812*b* and the front edge 812*a* of the recess 800. The end walls 808*a,b* may each be linear, curved, or a combination of both. Each end wall 808*a,b* generally angles inwardly from the rear wall 812*b* to the front edge 812*a* of the recess 800 at an included angle θ of approximately 26 degrees. The angle θ may vary to be larger or smaller, and the end walls may angle away from each other and still provide a stiffening effect. The angle θ and direction described herein are examples only.

Still referring to FIG. 8, each wheel housing recess 810*a*, 810*b* is defined by a sidewall 822*a*, 822*b* respectively. In some examples, each sidewall may include an at least partially concave shape directed away from the recess 800. The distance between each end wall 808*a, b* and its adjacent respective wheel housing sidewall 822*a,b* varies because of the curvature of the sidewall, the curvature of the end wall or both. Each end wall 808*a,b* of the recess may be closest to a middle portion 824*a,b* of the respective sidewall 822*a,b*, having a normal distance 826 therebetween of approximately 16 mm, with that distance increasing towards either end of the respective sidewall. The close spacing between the recess 800 and wheel housing features 810*a,b*, with varying dimensions between the two, create a strong structural configuration in the bottom wall that enhances the stiffness. The particular dimension and relative curvature noted above is an example only and may differ for differently-sized luggage cases.

The stiffening effect on the bottom panel 802 provided by the recess 800 is further enhanced by the non-planar shape of the top wall 820, as best seen in FIG. 10. The end walls

808*a,b* extend at an angle α from the bottom wall at approximately 50-60 degrees, and each transitions into the top wall 820. In one example, the angle α is approximately 55°. The top wall 820 is non-planar as it extends between the end walls 808*a,b* of the recess 800. The height of the top wall 820 may be symmetrical about the midway of the length of the recess 800. In one example the height dimension is greatest at the midway position between the end walls 808*a,b*. In another example the height dimension may be greatest in a central portion of the top wall, the central portion spanning the midway position and extending to either side approximately one eighth of the total length dimension. The height of the recess 800 may be based in part on the undercut and the depth of the shell. At the center portion of the recess 800, the shell may be relatively more deformable than near the end walls 808*a,b* and a relatively larger undercut may be used in the center portion of the recess 800 than near the end walls 808*a,b*. In one example, the undercut in the center portion of the recess may be about 3°, while the undercut near the end walls 808*a,b* may be about 0°. The height of the recess 800 at its center portion may be approximately in the range of 20-25 mm. The height dimension may taper off towards each end wall 808*a,b*. The height of the recess 800 at each end wall 808*a,b* may be approximately in the range of 12-15 mm. The shape of the non-planar upper wall 820 may include a continuous, segmented, or combination curve in the top wall 820. The maximum height of the recess 800 may be at a different position than the center portion, and/or there may be more than one location for the maximum height.

FIGS. 11 and 12 shows a further feature of the recess 800 that may further enhance the stiffening effect in the bottom panel 802. Referring to FIG. 12, the top wall 820 of the recess 800, along its central portion 828, slopes upwardly, such as in this example from the bottom panel towards a top panel of the luggage shell, from the front edge 812*a* to the rear wall 812*b* at an angle β of approximately 3 degrees from horizontal, creating an undercut angle. This undercut angle of the top wall 820 may decrease as the upper wall extends to the end walls 808*a,b* as shown in the section of FIG. 11. In some instances, the end walls 808*a,b* will have an angle of approximately 0 (no undercut angle) at the opposing end portions of the recess 800. The change in undercut angle from the central portion to the opposing end portions further enhances the stiffness the bottom panel 402.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

It is possible to express at least some of the novel and inventive features of the present disclosure by reference to one or more of the following numbered clauses.

1. A luggage case (102) comprising:
a first shell (116, 118) and a second shell (116, 118);
first engagement features (140) extending along an edge of the first shell (116, 118);
second engagement features (140) extending along an edge of the second shell (116, 118); an expansion webbing (304), positioned at least partially between the first and second shells (116, 118), and defining opposing first and second edges, with each opposing edge including engagement features (140), wherein:
the respective engagement features (140) of the first opposing edge and the first shell (116, 118) correspond to form a first openable zipper structure (602);
the engagement features (140) of the second opposing edge and the second shell (116, 118) correspond to form a second openable zipper structure (604);
an unreinforced gusset member (306, 424, 624) connected to the expansion webbing (304), and operably joined with the second shell (116, 118); and
wherein the first openable zipper structure (602) allows access to an interior chamber formed between the first and second shells (116, 118), and the second openable zipper structure (604) allows the gusset member (306, 424, 624) to extend to increase the volume of the interior chamber when in the open configuration.

2. The luggage case (102) as defined in clause 1, wherein the gusset member (306, 424, 624) is attached directly to the second luggage shell (116, 118).

3. The luggage case (102) as defined in clause 1, wherein:
the first engagement features (140) are attached to an elongated first zipper tape, and the elongated first zipper tape (328, 630, 631) is attached to the first luggage shell (116, 118);
the second engagement features (140) are attached to an elongated second zipper tape (328, 630, 631), and the elongated second zipper tape (328, 630, 631) is attached to the second luggage shell (116, 118); and
the gusset member (306, 424, 624) is attached to the elongated second zipper tape (328, 630, 631).

4. The luggage case (102) as defined in any of clauses 1-3, wherein the gusset member (306, 424, 624) is attached to the elongated second zipper tape (328, 630, 631) by a line of stitching.

5. The luggage case (102) as defined in any of clauses 1-4, wherein:
the expansion webbing (304), is an elongated strip of material.

6. The luggage case (102) as defined in any of clauses 1-5, wherein the expansion webbing (304) is a continuous piece of material.

7. The luggage case (102) as defined in any of clauses 1-6, wherein the expansion webbing (304) is made of a same material as the zipper tapes (328, 630, 631).

8. The luggage case (102) as defined in any of clauses 1-7, wherein the webbing material is a single layer or is a plurality of layers.

9. The luggage case (102) as defined in any of clauses 1-8, wherein:
the gusset member (306, 424, 624) defines an opposing first edge and an opposing second edge;
the opposing first edge is attached to the elongated first zipper tape (328, 630, 631); and
the opposing second edge is attached to the elongated second zipper tape (328, 630, 631).

10. An expansion zipper assembly for a luggage case (102) comprising:
a first zipper tape (328, 630, 631) including engagement features (140) along one edge; a second zipper tape (328, 630, 631) including engagement features (140) along one edge; an expansion webbing (304), defining opposing edges and positioned between the first and second zipper tapes (328, 630, 631), with each opposing edge forming an openable zipper structure with the adjacent engagement features (140) of the first or second zipper tape (328, 630, 631);

a gusset member (306, 424, 624) defining a first and second opposing edges, the first opposing edge attached to the expansion webbing (304), and the second opposing edge attached to second zipper tape (328, 630, 631).

11. A luggage case (102) comprising:

a first shell (116, 118) (116, 118) and a second shell (116, 118) (116, 118) defining an interior chamber;

an expansion zipper assembly attached between the first shell (116, 118) and the second shell (116, 118) including:

a first zipper tape (328, 630, 631) attached to the first shell (116, 118) and including engagement features (140) along one edge;

a second zipper tape (328, 630, 631) attached to the second shell (116, 118) and including engagement features (140) along one edge;

an expansion webbing (304), defining opposing edges and positioned between the first and second zipper tapes (328, 630, 631) with each opposing edge forming a selectively openable zipper structure with the adjacent engagement features (140) of the first or second zipper tape (328, 630, 631);

a gusset member (306, 424, 624) defining a first and second opposing edges, the first opposing edge attached to the expansion webbing (304), and the second opposing edge attached to the second zipper tape (328, 630, 631); and wherein the selective openable zipper structure formed between the first zipper tape (328, 630, 631) and the expansion webbing (304), defines a primary zipper structure allowing access to the interior chamber, and the selectively openable zipper structure formed between the second zipper tape (328, 630, 631) and the expansion webbing (304), defines an expansion zipper structure that when open allows the gusset member (306, 424, 624) to extend and expand the volume of the interior chamber.

12. The luggage case (102) as defined in clause 3, wherein:

the first and second zipper tapes (328, 630, 631) each comprise an elongated strip member (130, 132) associated with a respective said shell (116, 118), each elongated strip member (130, 132) including a first strip portion (134, 136) and a second strip portion (134, 136) joined along a first common edge;

the first strip portion (134, 136) including engagement features (140) along a first edge opposite the first common edge, and the first strip portion (134, 136) is attached near an edge of the respective shell (116, 118) between the first edge and the first common edge; and the second strip portion (134, 136) defines an inner edge, the second strip portion (134, 136) extending over at least a portion of a width of the first strip portion (134, 136) to cover the attachment of the first strip portion (134, 136) to the shell (116, 118).

13. The luggage case (102) of clause 12, wherein the first strip portion (134, 136) is attached to the respective shell (116, 118) by a line of stitching.

14. The luggage case (102) of any of clauses 13-14, wherein the second strip portion (134, 136) is free from direct attachment to the shell (116, 118).

15. The luggage case (102) of any of clauses 13-14 wherein the second strip portion (134, 136) is configured to be folded back to expose the line of connection.

16. The luggage case (102) of any of clauses 12-14, wherein the second strip portion (134, 136) includes a protective material.

17. The luggage case (102) of any of clauses 12-16, wherein the protective material is a thermoplastic material applied to the second strip portion (134, 136) or is a thermoplastic material impregnated into the second strip portion (134, 136).

18. The luggage case (102) any of clauses 12-17, wherein the first strip portion (134, 136) comprises webbing and the second strip portion (134, 136) comprises a webbing or a webbing together with a coating layer.

19. The luggage case (102) of any of clauses 12-18, wherein the engagement features (140) comprise zipper coils or zipper teeth.

20. The luggage case (102) of any of clauses 12-19, wherein the second strip portion (134, 136) is formed integrally with the first strip portion (134, 136) and the first common edge is formed by a fold, or is a separate piece from the first strip portion (134, 136) and is attached to the first strip portion (134, 136) to form the first common edge.

21. The luggage case (102) of any of clauses 12-20, wherein:

the second strip portion (134, 136) is a separate piece from the first strip portion (134, 136) and is attached to the first strip portion (134, 136) to form the first common edge; and wherein the second strip portion (134, 136) is a flexible thermoplastic material.

22. The luggage case (102) of any of clauses 12-19, wherein the second strip portion (134, 136) includes a rigid or semi rigid material.

23. The luggage case (102) of any of clauses 12-22, wherein the second strip portion (134, 136) is curved concave downwardly with respect to the first layer, and wherein a central region of the second layer is spaced away from the first layer.

24. The luggage case (102) of any of clauses 12-23, wherein the inner edge of the second strip portion (134, 136) at least partially engages along its length the first layer.

25. The luggage case (102) of any of clauses 12-24, wherein:

the elongated strip member (130, 132) further comprises a third strip portion (202, 404) joined along the first edge of the first strip portion (134, 136) to form a second common edge; and wherein the second common edge covers a free end of the edge of the respective shell (116, 118).

26. The luggage case (102) of clause 25, wherein:

the first strip portion (134, 136) extends over an outer surface of the respective shell (116, 118); and the third strip portion (134, 136) extends over an inner surface of the respective shell (116, 118).

27. The luggage case (102) of clauses 25-26, wherein:

the first strip portion (134, 136) and the third strip portion (202, 404) are attached near an edge of the respective shell (116, 118) between the first and second common edges.

28. The luggage case (102) of clause 27, wherein:

the first strip portion (134, 136) and the third strip portion (202, 404) are attached to the respective shell (116, 118) by a line of stitching.

29. The luggage case (102) of any of clauses 26-28, wherein:

the third strip portion (202, 404) is formed integrally with the first strip portion (134, 136) and the second common edge is formed by a fold, or the third strip portion (202, 404) is formed separate from the first strip portion (134, 136) and attached to the first strip portion (134, 136) to form the second common edge.

30. The luggage case (102) of clauses 3, wherein:

the second openable zipper defines a second opposing end, the second opposing end received in a clip;

at least a first slit is formed in the webbing portion between the attachment of the gusset portion to the webbing portion and the engagement features (140) of the second opposing edge, or is formed in the second zipper tape (328, 630, 631) between the attachment of the second engagement members and the attachment of the gusset member (306, 424, 624) to the second zipper tape (328, 630, 631); and the slit widens to form a gap when the expansion zipper is opened to allow second openable zipper to open and expand the internal volume of the luggage case (102).

31. The luggage case (102) as defined in clause 30, wherein:

at least a first slit is formed in the webbing portion between the attachment of the gusset portion to the webbing portion and the engagement features (140) of the second opposing edge; and at least a second slit is formed in the second zipper tape (328, 630, 631) between the attachment of the second engagement members and the attachment of the gusset member (306, 424, 624) to the second zipper tape (328, 630, 631); and each of the at least first and the at least second slits widen to each form at least one gap when the expansion zipper is opened, the at least one gap allow the second openable zipper to open and extend and expand the internal volume of the luggage case (102).

32. The luggage case (102) of clauses 3, wherein:

the first openable zipper defines first opposing ends, the first opposing ends positioned adjacent one another, the first opposing ends retained by a first clip;

the second openable zipper defines second opposing ends, the second opposing ends positioned adjacent one another, the second opposing ends retained by a second clip;

an end portion of each opposing end of the second zipper tape (328, 630, 631) deviates away from the edge of the second luggage shell (116, 118) when the expansion zipper is opened to allow the second openable zipper to extend and expand the internal volume of the luggage case (102).

33. The luggage case (102) of clause 32, wherein a gap is formed between the second zipper tape (328, 630, 631) and the second edge of the second luggage shell (116, 118).

34. The luggage case (102) of any of clauses 1-33, wherein:

the first openable zipper structure (602) defines first opposing ends adjacent one another;

the second openable zipper structure (604) defines second opposing ends adjacent one another;

the first and second adjacent opposing ends aligned with one another; and wherein a laterally expandable hinge overlies the first and second opposing ends.

35. The luggage case (102) of any of clauses 34, wherein the hinge is formed of an expandable material and defines a first edge coupled to the first shell (116, 118) and a second edge coupled to the second shell (116, 118), and extends over the first openable zipper structure (602) and the second openable zipper structure (604) in both the unexpanded configuration and in the expanded configuration.

36. The luggage case (102) of clause 35, wherein in the width of the hinge in the expanded configuration is approximately 55% greater than the width of the hinge in the expanded configuration.

37. The luggage case (102) of any of clauses 1-36, wherein:

the shell (116, 118) includes a bottom panel (818) defining a recess (800);

the recess (800) includes a length dimension defined by opposing end walls (808*a*, 808*b*), a depth dimension defined by a front edge (812*a*) and a rear wall (812*b*), and a height dimension defined by the bottom panel (818) and the top wall (820); and wherein at least a portion of the top wall (820) along its length forms an undercut and angles upwardly as it extends from the front edge (812*a*) to the rear wall (812*b*).

38. The luggage case (102) of clause 37, wherein:

the top wall (820) having an arcuate shape with a maximum height dimension at a central portion and being less than the maximum height at each of the opposing end walls (808*a*, 808*b*);

the distance between each opposing end wall (808*a*, 808*b*) and an adjacent curved sidewall of a wheel housing is smallest at a midpoint of each opposing end wall (808*a*, 808*b*); and the opposing end walls (808*a*, 808*b*) and front edge (812*a*) and rear wall combine to form a generally trapezoidal shape.

39. A luggage case (102) comprising:

a first shell (116, 118) and a second shell (116, 118);

a continuous closure assembly selectively joining the first and second shell (116, 118) and comprising:

an elongated strip member (130, 132) associated with each shell (116, 118), each elongated strip member (130, 132) including a first strip portion (134, 136) and a second strip portion (134, 136) joined along a first common edge;

the first strip portion (134, 136) including engagement features (140) along a first edge opposite the common edge, and the first strip portion (134, 136) is attached near an edge of the respective shell (116, 118) between the first edge and the first common edge; and the second strip portion (134, 136) defines an inner edge, the second strip portion (134, 136) extending over at least a portion of a width of the first strip portion (134, 136) to cover the attachment of the first strip portion (134, 136) to the shell (116, 118).

40. The luggage case (102) of clause 39, wherein the first strip portion (134, 136) is attached to the respective shell (116, 118) by a line of stitching.

41. The luggage case (102) of clause 39 or 40, wherein the second strip portion (134, 136) is free from direct attachment to the shell (116, 118) and can be folded back to expose the line of connection.

42. The luggage case (102) of any of clauses 39-41, wherein the second strip portion (134, 136) includes a protective material.

43. The luggage case (102) of any of clauses 39-42, wherein the protective material is a thermoplastic material applied to the second strip portion (134, 136) or is a thermoplastic material impregnated into the second strip portion (134, 136).

44. The luggage case (102) any of clauses 39-43, wherein the first strip portion (134, 136) comprises webbing and the second strip portion (134, 136) comprises a webbing or a webbing together with a coating layer.

45. The luggage case (102) of any of clauses 39-44, wherein the second strip portion (134, 136) is formed integrally with the first strip portion (134, 136) and the first common edge is formed by a fold, or is a separate piece from the first strip portion (134, 136) and is attached to the first strip portion (134, 136) to form the first common edge.

46. The luggage case (102) of any of clauses 39-45, wherein:

the second strip portion (134, 136) is a separate piece from the first strip portion (134, 136) and is attached to the first strip portion (134, 136) to form the first common edge; and wherein the second strip portion (134, 136) is a flexible thermoplastic material.

47. The luggage case (102) of any of clauses 39-46, wherein the second strip portion (134, 136) is curved concave downwardly with respect to the first layer, and wherein a central region of the second layer is spaced away from the first layer.

48. The luggage case (102) of any of clauses 39-47, wherein the inner edge of the second strip portion (134, 136) at least partially engages along its length the first layer.

49. The luggage case (102) of any of clauses 39-48, wherein:

the elongated strip member (130, 132) further comprises a third strip portion (202, 404) joined along the first edge of the first strip portion (134, 136) to form a second common edge; and wherein the second common edge covers a free end of the edge of the respective shell (116, 118).

50. The luggage case (102) of clause 49, wherein:

the first strip portion (134, 136) extends over an outer surface of the respective shell (116, 118); and the third strip portion (202, 404) extends over an inner surface of the respective shell (116, 118).

51. The luggage case (102) of clauses 49 or 50, wherein:

the first strip portion (134, 136) and the third strip portion (202, 404) are attached near an edge of the respective shell (116, 118) between the first and second common edges.

52. The luggage case (102) of clause 51, wherein:

the first strip portion (134, 136) and the third strip portion (202, 404) are attached to the respective shell (116, 118) by a line of stitching.

53. The luggage case (102) of any of clauses 49-52, wherein:

the third strip portion (202, 404) is formed integrally with the first strip portion (134, 136) and the second common edge is formed by a fold, or the third strip portion (202, 404) is formed separate from the first strip portion (134, 136) and attached to the first strip portion (134, 136) to form the second common edge.

54. The luggage case (102) of any of clauses 48-53, wherein the engagement features (140) are affixed to the second common edge.

55. A luggage case (102) including a shell (116, 118) and a continuous closure structure, the continuous closure structure including a protective cover and separately or additionally an expansion zipper (600), the continuous closure assembly (128, 200, 300, 400) of the continuous closure structure including a first strip portion (134) and a second strip portion (136) connected along a common outer edge, the second strip portion (136) overlaying a portion of the first strip portion (134), the expansion zipper assembly (600) of the continuous closure structure including a central webbing portion (610) having zipper teeth (148) on opposing sides, and a gusset member (624) secured between the shell (116, 118) and the central webbing portion (610).

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A luggage case comprising:

a first shell and a second shell;

first engagement features extending along an edge of the first shell;

second engagement features extending along an edge of the second shell;

an expansion webbing, positioned at least partially between the first and second shells, and defining opposing first and second edges, with each opposing edge including engagement features, wherein:

the respective engagement features of the first opposing edge and the first shell correspond to form a first openable zipper structure;

the engagement features of the second opposing edge and the second shell correspond to form a second openable zipper structure;

an unreinforced gusset member connected to the expansion webbing, and operably joined with the second shell; and wherein the first openable zipper structure is arranged to allow access to an interior chamber formed between the first and second shells, and the second openable zipper structure is arranged to allow the gusset member to extend to increase the volume of the interior chamber when in an open configuration.

2. The luggage case as defined in claim 1, wherein the gusset member is attached directly to the second luggage shell.

3. The luggage case as defined in claim 1, wherein:

the first engagement features are attached to an elongated first zipper tape, and the elongated first zipper tape is attached to the first luggage shell;

the second engagement features are attached to an elongated second zipper tape, and the elongated second zipper tape is attached to the second luggage shell; and the gusset member is attached to the elongated second zipper tape.

4. The luggage case as defined in claim 3, wherein the gusset member is attached to the elongated second zipper tape by a line of stitching.

5. The luggage case as defined in claim 3, wherein:

the gusset member defines an opposing first edge and an opposing second edge;

the opposing first edge is attached to the elongated first zipper tape; and the opposing second edge is attached to the elongated second zipper tape.

6. The luggage case as defined in claim 1, wherein:

the expansion webbing is an elongated strip of material.

7. The luggage case as defined in claim 1, wherein the expansion webbing is a continuous piece of material.

8. The luggage case as defined in claim 1, wherein the expansion webbing is made of a same material as the zipper tapes.

9. The luggage case as defined in claim 1, wherein the webbing material is a single layer or is a plurality of layers.

10. An expansion zipper assembly for a luggage case comprising:

a first zipper tape including engagement features along one edge;

a second zipper tape including engagement features along one edge;

an expansion webbing, defining opposing edges and positioned between the first and second zipper tapes, with each opposing edge forming an openable zipper structure with the adjacent engagement features of the first or second zipper tape;

a gusset member defining a first and second opposing edges, the first opposing edge attached to the expansion webbing, and the second opposing edge attached to second zipper tape.

11. The luggage case of claim 10, wherein the second strip portion is curved concave downwardly with respect to a first layer, and wherein a central region of a second layer is spaced away from the first layer.

12. The luggage case of claim 10, wherein:

the first and second zipper tapes each comprise an elongated strip member associated with the each shell, each elongated strip member including a first strip portion and a second strip portion joined along a first common edge;

the first strip portion including engagement features along a first edge opposite the first common edge, and the first strip portion is attached near an edge of the respective shell between the first edge and the first common edge; and the second strip portion defines an inner edge, the second strip portion extending over at least a portion of a width of the first strip portion to cover the attachment of the first strip portion to the shell;

wherein the first strip portion is attached to the respective shell by a line of stitching.

13. The luggage case of claim 12, wherein the second strip portion is free from direct attachment to the shell;

wherein the second strip portion is configured to be folded back to expose a line of connection.

14. The luggage case of claim 12, wherein the second strip portion is formed integrally with the first strip portion and the first common edge is formed by a fold, or is a separate piece from the first strip portion and is attached to the first strip portion to form the first common edge;

wherein:

the second strip portion is a separate piece from the first strip portion and is attached to the first strip portion to form the first common edge, and wherein the second strip portion is a flexible thermoplastic material, and/or wherein the second strip portion includes a rigid or semi rigid material.

15. The luggage case of claim 12, wherein the second strip portion includes a protective material.

16. The luggage case of claim 15, wherein the protective material is a thermoplastic material applied to the second strip portion or is a thermoplastic material impregnated into the second strip portion;

wherein the first strip portion comprises webbing and the second strip portion comprises a webbing or a webbing together with a coating layer and/or wherein the engagement features comprise zipper coils or zipper teeth.

* * * * *